US007595776B2

(12) United States Patent
Hashimoto et al.

(10) Patent No.: US 7,595,776 B2
(45) Date of Patent: Sep. 29, 2009

(54) DISPLAY APPARATUS, AND DRIVING CIRCUIT FOR THE SAME

(75) Inventors: Yoshiharu Hashimoto, Kawasaki (JP); Teru Yoneyama, Kawasaki (JP)

(73) Assignee: NEC Electronics Corporation, Kanagawa (JP)

( * ) Notice: Subject to any disclaimer, the term of this patent is extended or adjusted under 35 U.S.C. 154(b) by 914 days.

(21) Appl. No.: 11/045,608

(22) Filed: Jan. 31, 2005

(65) Prior Publication Data

US 2005/0168416 A1 Aug. 4, 2005

(30) Foreign Application Priority Data

Jan. 30, 2004 (JP) ..... 2004-022974
Sep. 28, 2004 (JP) ..... 2004-282758

(51) Int. Cl.
*G09G 3/30* (2006.01)

(52) U.S. Cl. ..... 345/76; 345/690

(58) Field of Classification Search ..... 345/44–52, 345/63–64, 76–77, 81–84, 87–89, 95, 100, 345/204, 210–212, 214, 690, 699; 315/169.3
See application file for complete search history.

(56) References Cited

U.S. PATENT DOCUMENTS 7,050,028 B2 * 5/2006 Morita ..... 345/90
7,158,156 B2 * 1/2007 Endou ..... 345/690
7,187,375 B2 * 3/2007 Ha et al. ..... 345/212
2002/0196214 A1 * 12/2002 Park et al. ..... 345/82
2005/0200584 A1 * 9/2005 Kudo et al. ..... 345/89

FOREIGN PATENT DOCUMENTS

JP 2148687 6/1990
JP 2003195812 7/2003
JP 2003223140 8/2003

* cited by examiner

*Primary Examiner*—Richard Hjerpe
*Assistant Examiner*—Mansour M Said
(74) *Attorney, Agent, or Firm*—Young & Thompson

(57) ABSTRACT

A drive circuit for a display apparatus includes a gradation voltage generation circuit and a D/A conversion circuit. The gradation voltage generation circuit generates a plurality of different first gradation voltages and a plurality of different second gradation voltages. The D/A conversion circuit drives a light emitting element of a pixel through a data line with a gradation voltage based on one of the first gradation voltages as a first specific gradation voltage in a precharge period and drives the light emitting element of the pixel through the data line with a gradation current based on one of the second gradation voltages as a second specific gradation voltage. The D/A conversion circuit includes a voltage driver to drive the light emitting element, and a current driver to drive the light emitting element.

34 Claims, 32 Drawing Sheets

Fig. 16

| GRADATION SETTING DATA | GAMMA |
|---|---|
| 0000 | 1.70 |
| 0001 | 1.75 |
| 0010 | 1.80 |
| 0011 | 1.85 |
| 0100 | 1.90 |
| 0101 | 1.95 |
| 0110 | 2.00 |
| 0111 | 2.05 |
| 1000 | 2.10 |
| 1001 | 2.15 |
| 1010 | 2.20 |
| 1011 | 2.25 |
| 1100 | 2.30 |
| 1101 | 2.35 |
| 1110 | 2.40 |
| 1111 | 2.45 |

SWITCHES: 32+2

SWITCHES: 32

SWITCHES: 16+2

DISPLAY APPARATUS, AND DRIVING CIRCUIT FOR THE SAME

BACKGROUND OF THE INVENTION

1. Field of the Invention

The present invention relates to a display apparatus such as a flat-panel display apparatus, a driving circuit for the display apparatus, and a semiconductor device for the driving circuit.

2. Description of the Related Art

The importance of an apparatus to mediate a man or woman and a machine (man-machine interface) has been increased with the advance of computer technology. Especially, a display apparatus as one of the man-machine interfaces on the output side is required to have higher performance. The display apparatus displays data outputted from a computer for a man to visibly recognize the data. Various kinds of display apparatuses are commercially available. A typical display apparatus is a flat-panel display and is widespread.

The flat-panel display apparatus is exemplified by a liquid crystal display and an organic electro-luminescence display apparatus using organic electro-luminescence. The organic electro-luminescence display apparatus has a merit that the display panel is thinner compared with the liquid crystal display. Moreover, the organic electro-luminescence display apparatus is superior in a viewing angle characteristic.

A driving method of the flat-panel display apparatus, especially the organic electro-luminescence display apparatus is mainly classified into two. That is, one is a simple matrix type driving method and the other is an active matrix type driving method. The simple matrix type driving method is suitable for a small-size display apparatus such as a mobile terminal because the structure is simple. However, the method has a problem in a response speed. Therefore, it is not suitable for a large-size display such as a television screen. Thus, the active matrix type driving method is used for a television and a personal computer. As a technique applied to the active matrix type driving method, a TFT (Thin Film Transistor) active matrix method is widely known, in which TFT is used as a pixel. For example, a TFT active matrix method is disclosed in Japanese Laid Open Patent Application (JP-P2003-195812A). The TFT active matrix method is further classified into two. One is a voltage drive type, and the other is a current drive type.

FIG. 1 is a block diagram showing the circuit configuration of a conventional organic electro-luminescence display apparatus 100. As shown in FIG. 1, the display apparatus 100 includes a data line driving circuit 101, a scanning line driving circuit 102, a control circuit 103, and a display panel 104. The display panel 104 has a plurality of data lines 111 arranged in a column direction, i.e., a vertical direction. Each data line 111 is connected with the data line driving circuit 101. Similarly, the display panel 104 has a plurality of scanning lines 121 arranged in a row direction. Each scanning line 121 is connected with the scanning line driving circuit 102. In addition, the display panel 104 has a pixel 105 at each of intersections of the plurality of data lines 111 and the plurality of scanning lines 121.

The data line driving circuit 101 and the scanning line driving circuit 102 are connected with the control circuit 103. The data line driving circuit 101 supplies a voltage or current to each of the plurality of data lines 111 in response to a pixel control signal outputted from the control circuit 103. The scanning line driving circuit 102 supplies a voltage or current to each of the plurality of scanning lines 121 as well as the data line driving circuit 101 in response to the pixel control signal outputted from the control circuit 103.

The control circuit 103 controls the data line driving circuit 101 and the scanning line driving circuit 102. The control circuit 103 receives display data to be displayed on the display panel 104 and a control signal corresponding to the display data, and outputs the pixel control signal based on the display data and the control signal. The pixel control signal is to control the data line driving circuit 101 and the scanning line driving circuit 102. The display panel displays the display data as a display image by driving a light-emitting element of each pixel 105 based on the outputs of the data line driving circuit 101 and the scanning line driving circuit 102.

The display apparatus 100 shown in FIG. 1 is driven based on a sequential line driving and scanning method. The scanning line driving circuit 102 drives the plurality of scanning lines 121 in a predetermined order in response to a scan sync signal. The data line driving circuit 101 drives the plurality of data lines 111 in relation to the scanning line 121 selectively driven by the scanning line driving circuit 102 so that the pixel 105 displays the display data. The data line driving circuit 101 drives each data line 111 by dividing a period for displaying the display data (to be referred to as a data line drive period) into two periods, one being a first period to referred to as a precharge period and a second period to be referred to as an current drive period.

FIG. 2 is a circuit diagram of the pixel 105 of the display apparatus 100 in the active matrix type driving method. As shown in FIG. 2, the pixel 105 includes an electro-luminescent element 130 as a light-emitting element, a drive TFT 131, a switch 132, and a capacitor 135. The electro-luminescent element 130 emits light in accordance with an EL (Electro Luminescence) phenomenon. The drive TFT 131 is connected between the electro-luminescent element 130 and a ground potential GND. The source of the drive TFT 131 is connected with the ground potential GND. The switch 132 is provided for each pixel 105 which is arranged in each of the intersections of the data lines 111 and the scanning lines 121. The switch 132 is connected with the gate of the drive TFT 131 through a node 133. The capacitor 135 is a capacitive element. As shown in FIG. 2, the capacitor 135 is connected between the node 133 and the ground potential GND.

FIG. 3 is a block diagram showing the circuit configuration of the data line driving circuit 101. As shown in FIG. 3, the data line driving circuit 101 includes a shift register circuit 112, a data register circuit 113, a data latch circuit 114, a D/A conversion circuit 115, an input buffer circuit 116, a timing control circuit 117, and a reference current source 118. The data register circuit 113 is a memory circuit to store the display data. The data register circuit 113 stores the above-mentioned display data in synchronism with a signal outputted from the shift register circuit 112. The data latch circuit 114 reads out the display data stored in the data register circuit 113 in synchronism with a latch signal from the timing control circuit 117, and outputs the read data to the D/A conversion circuit 1. The D/A conversion circuit 115 generates a current to be outputted onto the data line based on the data from the data latch circuit 114.

The input buffer circuit 116 carries out bit inversion to the display data based on an inversion control signal in synchronism with a clock signal CLK and outputs the inverted result to the data register circuit 113. The timing control circuit 117 controls operation timings of the data latch circuit 114, the D/A conversion circuit 115, and the reference current source 118 in response to a horizontal sync signal STB in synchronism with the clock signal CLK. The reference current source 118 provides a reference current to the D/A conversion circuit 115. Therefore, in the data line driving circuit 101 shown in FIG. 3, the serial display data is converted into parallel display data through the operations of the shift register circuit 112 and the data register circuit 113. The parallel display data is outputted to the data latch circuit 114. The data latch circuit 114 latches the parallel display data in synchronism with the scanning of the scanning lines. The D/A conversion circuit 115 reads out the parallel display data latched by the data latch circuit 114 for each scanning line, and outputs the display data sequentially during a horizontal drive period.

FIG. 4 is a circuit diagram showing the circuit configuration of the D/A conversion circuit 115. As shown in FIG. 4, the D/A conversion circuit 115 includes a converter circuit 151 and a precharge circuit 152 for every one or more data lines. The converter circuit 151 carries out D/A conversion of a plurality of reference currents weighted in a binary manner by using the display data to generate gradation currents for the display data. The precharge circuit 152 includes a quasi-addition circuit 153, a voltage driver 154, and switches 155, 156, and 157. The precharge circuit 152 generates a gradation voltage adaptive for the input impedance characteristic of the pixel 105 based on the gradation current from the converter circuit 151 by the quasi-addition circuit 153 and the voltage driver 154 which have the same impedance characteristic as the input impedance characteristic of the pixel 105 shown in FIG. 2. In addition, the precharge circuit 152 outputs a gradation voltage and gradation current to carry out the voltage drive and current drive of the data line in the order of the precharge period and the current drive period in one horizontal drive period through switching of the switches 155, 156, and 157.

In the data line driving circuit 101, the data line drive period for the drive of the data line is divided into the two periods of the precharge period and the current drive period. In the precharge period, the data line driving circuit 101 drives the data line 111 by a voltage drive circuit with a high drive ability (Hereinafter, this drive is referred as a voltage drive). In the current drive period, the data line driving circuit 101 drives the data line 111 by a constant current source circuit in a current with a constant current value (Hereinafter, this drive is referred as a current drive). The data line driving circuit 101 outputs the gradation voltage in the precharge period to drive the data line 111 in the voltage drive. The capacitor 135 for each pixel 105 is charged up to a predetermined voltage in a short time with the outputted gradation voltage. In addition, the pixel 105 is driven in high accuracy by the gradation current outputted from the data line driving circuit 101 in the current drive period so as to achieve display with high accuracy.

In the conventional display apparatus 100, the display data is converted so as to be adaptive for a specific gamma characteristic by the driving circuit. For instance, when the display data from a CPU is of 6 bits, the display data is converted to have increased bits for producing the display data adaptive to the gamma characteristic. The conversion of the display data is carried out by the control circuit 103. In the above Japanese Laid Open Patent Application (JP-P2003-195812A), the control circuit 103 converts the display data to have 10 bits or more in accordance with a conversion table, and supplies the converted display data to the data line driving circuit 101. At this time, the data line driving circuit 101 is required for the D/A conversion circuit 115 to have the resolution of 10 bits or more to drive the data line based on the converted display data. The converter circuit 151 of the D/A conversion circuit 115 is provided with transistors which have a same channel length L but different channel widths W of $2^n$. Otherwise, the D/A conversion circuit 115 may be provided with transistors which have the same channel length L and the same channel width W and which are controlled in accordance with different reference currents of $2^n$. If the display data is of 10 bits, the circuit scale has to be large because the converter circuit 151 is provided with at least ten transistors. Especially, in the former configuration, since the channel width W is dependent on $2^n$, the chip area is enlarged very much. In addition, power consumption becomes large in an interface between the control circuit 103 and the data line driving circuit 101 because the number of bits is increased. Moreover, an output capacitance becomes large because the D/A conversion circuit 115 in the data line driving circuit 101 is provided with the plurality of transistors. Here, a current I, a drive voltage V, a capacitance C, and a driving time T satisfy the following relation:

$$I=CV/T$$

The time T is determined from the number of scanning lines and a frame frequency. Therefore, the current value is increased as the capacity increases. As a result, it is difficult to drive the data line in a low current level. A driving circuit with a small chip area is required for a display apparatus. In addition, a driving circuit in low power consumption is required for a display apparatus.

Moreover, a transparent substrate (for instance, a glass substrate) is used for the display panel 104 in the conventional display apparatus 100. When the display panel 104 is manufactured by using the glass substrate, a deviation in characteristics of the transistors formed on the glass substrate is ten times or more larger than that in characteristic of the transistors formed on a silicon substrate. Therefore, if the data line driving circuit is formed on the glass substrate, ununiform display tends to be generated easily. Thus, the data line driving circuit is preferably formed on the silicon substrate. Forming the data line driving circuit 101 on the silicon substrate, it is difficult that the quasi-addition circuit 153 included in the data line driving circuit 101 has the same characteristic as the pixel 105 formed on the glass substrate, resulting in decrease in the reliability of the circuit. Thus, a driving circuit for the display apparatus with high reliability is required.

Furthermore, when a switching is carried out from the voltage drive to the current drive, glitch is generated sometimes in the conventional display apparatus 100. The glitch causes lowering image quality, especially in a low brightness (low current region) because a voltage is drifted from a desired voltage, even if the voltage is precharged to a desired voltage at high speed by the voltage driver. Therefore, a display apparatus is demanded in which the image quality and reliability are improved, while restraining the generation of the glitch.

In conjunction with the above description, an EL display apparatus is disclosed in Japanese Laid Open Patent Application (JP-P2003-223140A). In this conventional example, the EL display apparatus includes an EL element. A drive circuit drives the EL element in current in accordance with a PAM method in correspondence to a gradation level of display data. A precharge circuit applies a precharge voltage corresponding to the gradation level before the drive circuit supplies the current to the EL element.

Also, an EL storage display apparatus is disclosed in Japanese Laid Open Patent Application (JP-A-Heisei 2-148687). In this conventional example, the EL storage display apparatus includes a brightness control circuit, an EL element, a plurality of memory elements provided for the EL element, and a current source connected with the EL element. A plurality of current control elements are respectively provided for the memory elements, and control a current supplied from the current source to the EL element based on signals stored in the memory elements. The signal indicating a brightness requested from the El element is supplied to the memory element.

SUMMARY OF THE INVENTION

In an aspect of the present invention, a drive circuit for a display apparatus includes a gradation voltage generation circuit and a D/A conversion circuit. The gradation voltage generation circuit generates a plurality of first gradation voltages different from each other and a plurality of second gradation voltages different from each other. The D/A conversion circuit drives a light emitting element of a pixel through a data line with a gradation voltage based on one of the plurality of first gradation voltages as a first specific gradation voltage in a precharge period and drives the light emitting element of the pixel through the data line with a gradation current based on one of the plurality of the second gradation voltages as a second specific gradation voltage.

Here, the D/A conversion circuit includes a voltage driver drive the light emitting element with the gradation voltage based on the first specific gradation voltage in the first period, and a current driver drive the light emitting element with the gradation current based on the second specific gradation voltage to in the second period. In this case, the pixel includes a driving transistor to drive the light emitting element, the current driver includes a current driver transistor, and a conductive type of the driving transistor is opposite to that of the current driver transistor.

In the gradation voltage generating circuit, a first gradation voltage generating circuit generates the plurality of first gradation voltages adaptive for a current-voltage characteristic of the pixel, and a second gradation voltage generating circuit generates the second plurality of gradation voltages adaptive for a gamma characteristic of the light emitting element of the pixel. A multiplexer selects the plurality of first gradation voltages in the first period to output to the D/A conversion circuit, and to selects the plurality of second gradation voltages in the second period to output to the D/A conversion circuit. At this time, the first gradation voltage generating circuit generates the plurality of first gradation voltages based on first gradation setting data, and the second gradation voltage generating circuit generates the second plurality of gradation voltages based on second gradation setting data.

Also, in the gradation voltage generating circuit, a first gradation setting data register may hold first gradation setting data, a second gradation setting data register may hold second gradation setting data. A multiplexer selects the first gradation setting data in the first period, and select the second gradation setting data in the second period, and a gradation voltage generating circuit may generate the plurality of first gradation voltages based on the first gradation setting data in the first period, and to generate the plurality of second gradation voltages based on the second gradation setting data in the second period.

In the D/A conversion circuit, a first switch is interposed between the voltage driver and the data line, such that the first switch connects the voltage driver with the data line in the first period and disconnects the voltage driver from the data line in the second period.

In this case, the D/A conversion circuit may further include a decoder decode display data, a gradation voltage selecting circuit select the first specific gradation voltage from the plurality of first gradation voltages in the first period based on the display data decoded by the decoder to supply to the voltage driver, and to select the second specific gradation voltage from the plurality of second gradation voltages in the second period based on the display data decoded by the decoder to supply to the current driver. The first switch is connected between the first gradation voltage selecting circuit and the data line. A second switch may be interposed between the current driver and the data line, such that the second switch disconnects the current driver from the data line in the first period, and connects the current driver with the data line in the second period.

Instead, the D/A conversion circuit may include a decoder decode display data, a first gradation voltage selecting circuit selects the first specific gradation voltage from the plurality of first gradation voltages in the first period to supply to the voltage driver, and a second gradation voltage selecting circuit selects the second specific gradation voltage from the plurality of second gradation voltages in the second period to supply to the current driver. The first switch is connected between the first gradation voltage selecting circuit and the data line.

In the first gradation voltage generating circuit, a first reference voltage generating circuit generates a plurality of voltages, and a first selector circuit selects a first reference voltage and a second reference voltage from the plurality of voltages supplied from the reference voltage generating circuit based on the first setting data. A first voltage follower circuit carries out impedance conversion of the first reference voltage and the second reference voltage, and a first resistance string circuit voltage-divides a voltage difference between the first reference voltage and the second reference voltage after the impedance conversion and generates the plurality of first gradation voltages. Instead, in the first gradation voltage generating circuit, a first reference voltage generating circuit may generate a plurality of voltages, and a first selector circuit may select a first reference voltage and a second reference voltage from the plurality of voltages supplied from the reference voltage generating circuit based on the first setting data. A first voltage follower circuit carries out impedance conversion of the first reference voltage and the second reference voltage, and a second resistance string circuit voltage-divides a voltage difference between the first reference voltage and the second reference voltage after the impedance conversion and generates a plurality of voltages. A correcting circuit corrects the plurality of voltages generated by the second resistance string circuit based on first setting data.

Also, in the second gradation voltage generating circuit, a second reference voltage generating circuit may generate a plurality of voltages based on first and second voltage, and a first voltage supply circuit may supply the first voltage to the reference voltage generating circuit. A second voltage supply circuit may supply the second voltage to the reference voltage generating circuit, and a second selector circuit selects a third reference voltage and a fourth reference voltage from the plurality of voltages supplied from the reference voltage generating circuit based on second setting data, and a second voltage follower circuit carries out impedance conversion to the third reference voltage and the fourth reference voltage. A third resistance string circuit voltage-divides a voltage difference between the third reference voltage and the fourth reference voltage after the impedance conversion to adapt to a gamma characteristic of the light emitting element and generates the plurality of second gradation voltages. The second gradation voltage generating circuit may further include a fourth resistance string circuit generate a plurality of voltages by voltage-dividing the voltage difference between the third reference voltage and the fourth reference voltage after the impedance conversion, and a correcting circuit correct the plurality of second gradation voltages from the plurality of voltages generated by the fourth resistance string circuit based on the second setting data.

In another aspect of the present invention, a display apparatus includes a plurality of data lines; a plurality of scanning lines arranged in a direction orthogonal to the plurality of data lines; a pixel arranged at each of intersections the plurality of data lines and the plurality of scanning lines, wherein the pixel has a light emitting element which changes a brightness in response to a supplied signal; and a data line driving circuit drive each of the plurality of data lines when each of the plurality of scanning lines is selected. The data line drive circuit includes a gradation voltage generation circuit generate a plurality of first gradation voltages different from each other and a plurality of second gradation voltages different from each other; and a D/A conversion circuit drive a light emitting element of a pixel through a data line with a gradation voltage based on one of the plurality of first gradation voltages as a first specific gradation voltage in a precharge period and to drive the light emitting element of the pixel through the data line with a gradation current based on one of the plurality of the second gradation voltages as a second specific gradation voltage.

Here, the D/A conversion circuit may include a voltage driver drive the light emitting element with the gradation voltage based on the first specific gradation voltage in the first period; and a current driver drive the light emitting element with the gradation current based on the second specific gradation voltage to in the second period.

In the gradation voltage generating circuit, a first gradation voltage generating circuit generates the plurality of first gradation voltages adaptive for a current-voltage characteristic of the pixel, and a second gradation voltage generating circuit generates the second plurality of gradation voltages adaptive for a gamma characteristic of the light emitting element of the pixel. A multiplexer is connected with the first gradation voltage generating circuit and the second gradation voltage generating circuit to select the plurality of first gradation voltages in the first period to output to the D/A conversion circuit, and to select the plurality of second gradation voltages in the second period to output to the D/A conversion circuit.

In the gradation voltage generating circuit, a first gradation setting data register holds first gradation setting data, and a second gradation setting data register holds second gradation setting data. A multiplexer selects the first gradation setting data in the first period, and selects the second gradation setting data in the second period. Thus, a gradation voltage generating circuit generates the plurality of first gradation voltages based on the first gradation setting data in the first period, and generates the plurality of second gradation voltages based on the second gradation setting data in the second period.

In the D/A conversion circuit, a first switch is interposed between the voltage driver and the data line, such that the first switch connects the voltage driver with the data line in the first period and disconnects the voltage driver from the data line in the second period, and a decoder decodes display data. A gradation voltage selecting circuit selects the first specific gradation voltage from the plurality of first gradation voltages in the first period based on the display data decoded by the decoder to supply to the voltage driver, and selects the second specific gradation voltage from the plurality of second gradation voltages in the second period based on the display data decoded by the decoder to supply to the current driver.

Also, in the D/A conversion circuit, a first switch is interposed between the voltage driver and the data line, such that the first switch connects the voltage driver with the data line in the first period and disconnects the voltage driver from the data line in the second period, and a decoder decodes display data. A first gradation voltage selecting circuit selects the first specific gradation voltage from the plurality of first gradation voltages in the first period to supply to the voltage driver. A second gradation voltage selecting circuit selects the second specific gradation voltage from the plurality of second gradation voltages in the second period to supply to the current driver. The first switch is connected between the first gradation voltage selecting circuit and the data line.

A row of specific connection pads is preferably provided between a row of connection pads for input signals and power supply voltages and a row of pads for output terminals of the D/A conversion circuit, and a plurality of first power supply voltages are supplied to the voltage drivers through the row of specific connection pads.

It is desirable that the gradation voltage generating circuit and the gradation voltage selecting circuit are separated for each of RGB colors and are arranged in a continuous area.

Also, at least one of the gradation voltage generating circuit and the D/A conversion circuit is preferably formed on a semiconductor chip.

When the pixel is formed on a glass substrate, the current driver and the second gradation voltage generating circuit are preferably formed on a semiconductor chip.

BRIEF DESCRIPTION OF THE DRAWINGS

FIG. 16 is a table showing the correspondence of gradation setting data and gamma values;

DESCRIPTION OF THE PREFERRED EMBODIMENTS

Hereinafter, a display apparatus using a driving circuit of the present invention will be described in detail with reference to the attached drawings. In the following description, a display panel apparatus as one feature of the present invention is driven by a sequential line driving method to display an image. However, it should be noted that driving method for the display panel apparatus of the present invention is not limited to the sequential line driving method.

First Embodiment

Figure 1:
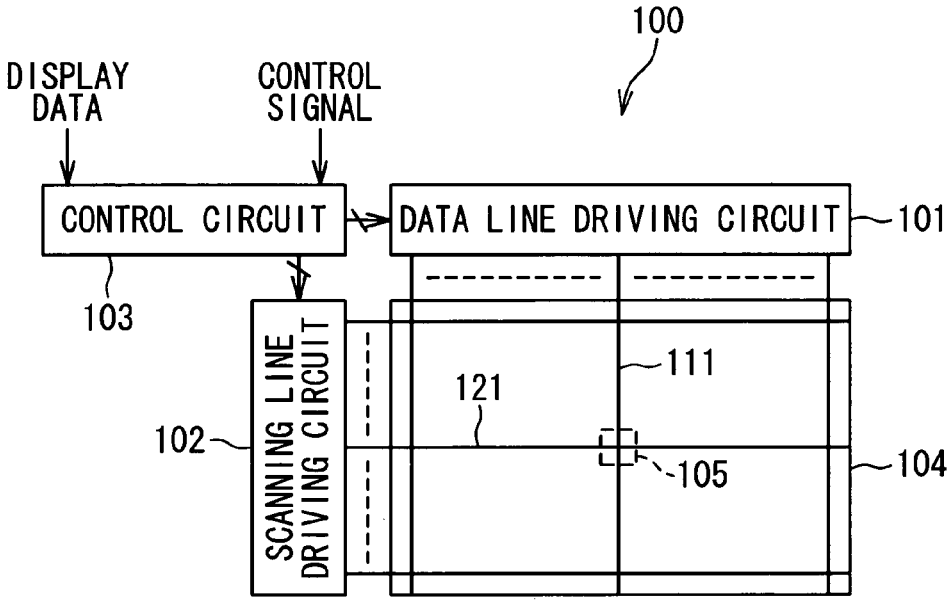
Fig. 1 PRIOR ART
FIG. 1 is a block diagram showing the circuit configuration of a conventional organic electro-luminescence display apparatus.
Figure 2:
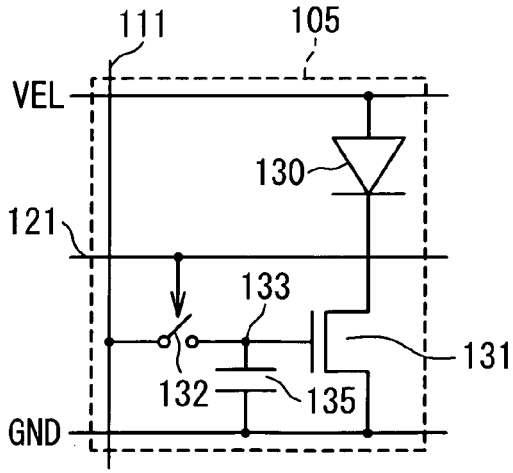
Fig. 2 PRIOR ART
FIG. 2 is a circuit diagram of a pixel of a display apparatus in an active matrix type driving method.
Figure 3:
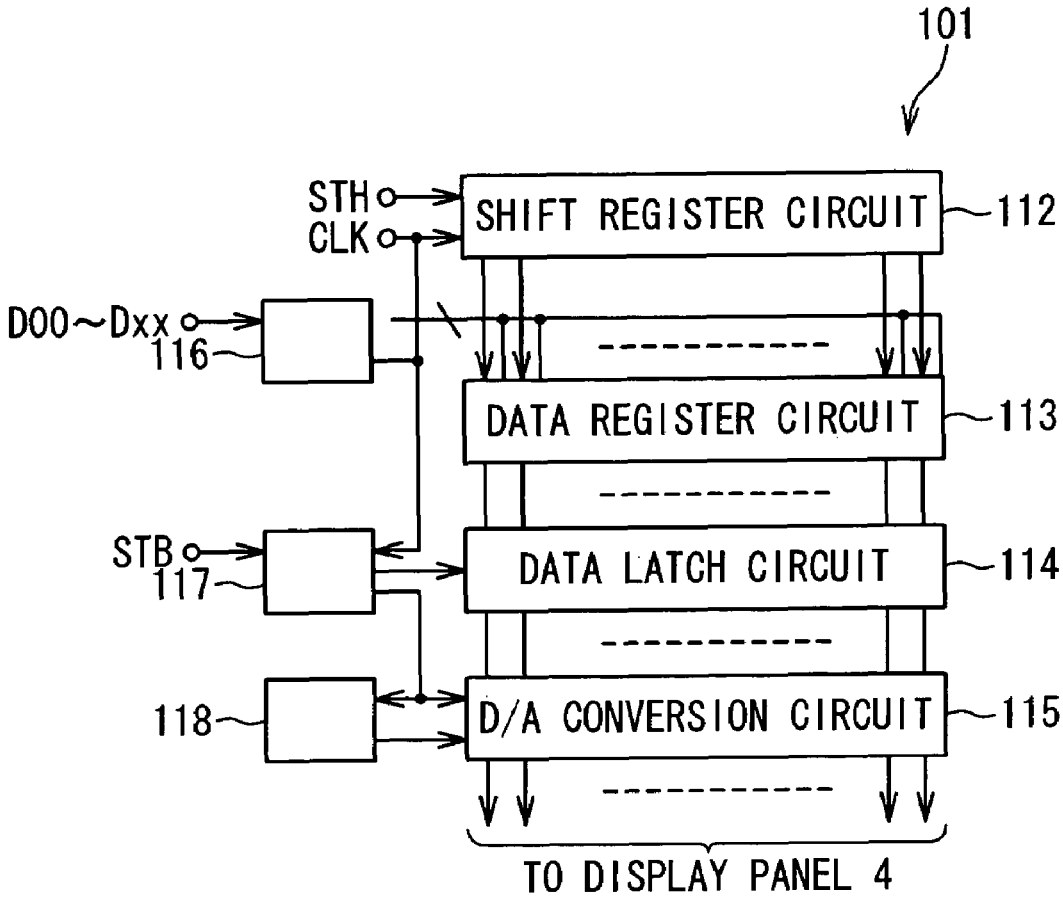
Fig. 3 PRIOR ART
FIG. 3 is a block diagram showing the circuit configuration of a data line driving circuit in the conventional organic electro-luminescence display apparatus.
Figure 4:
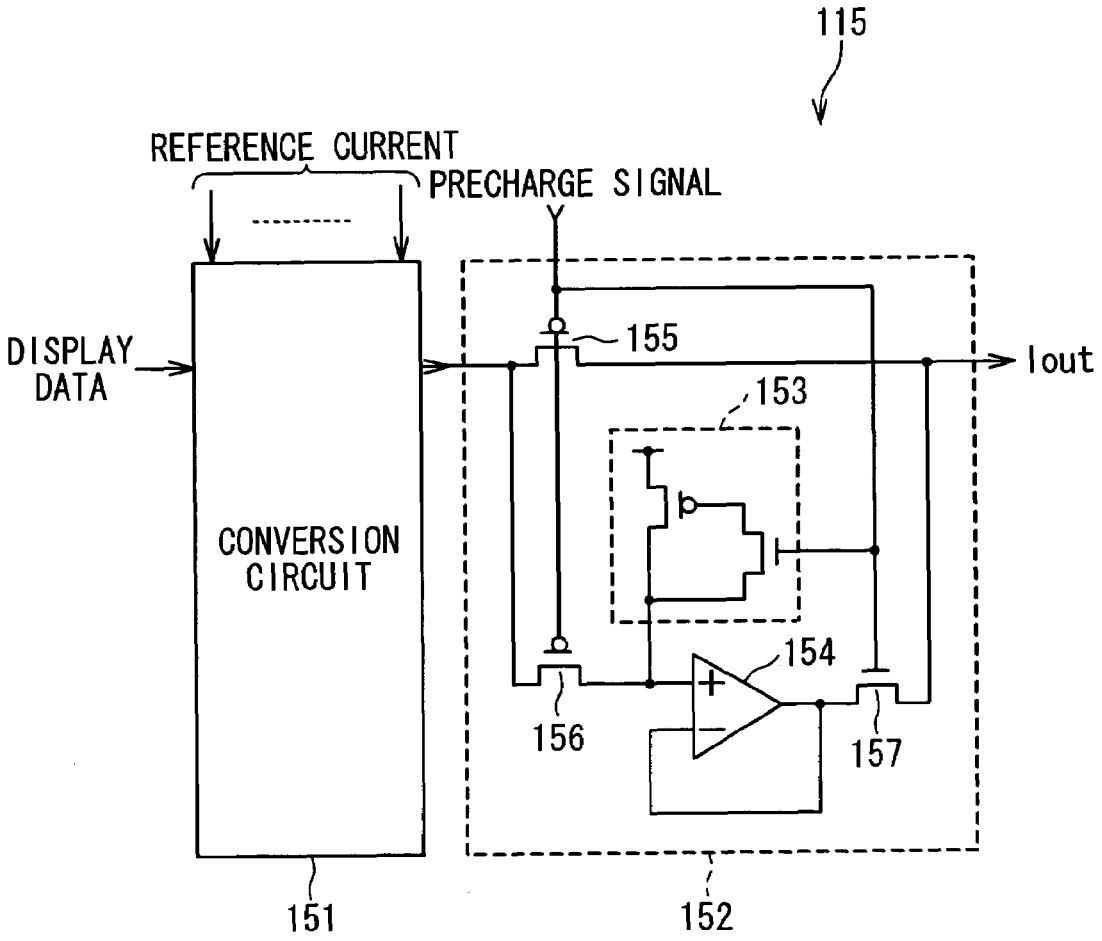
Fig. 4 PRIOR ART
FIG. 4 is a circuit diagram showing the circuit configuration of a D/A conversion circuit in the conventional organic electro-luminescence display apparatus.
Figure 5:
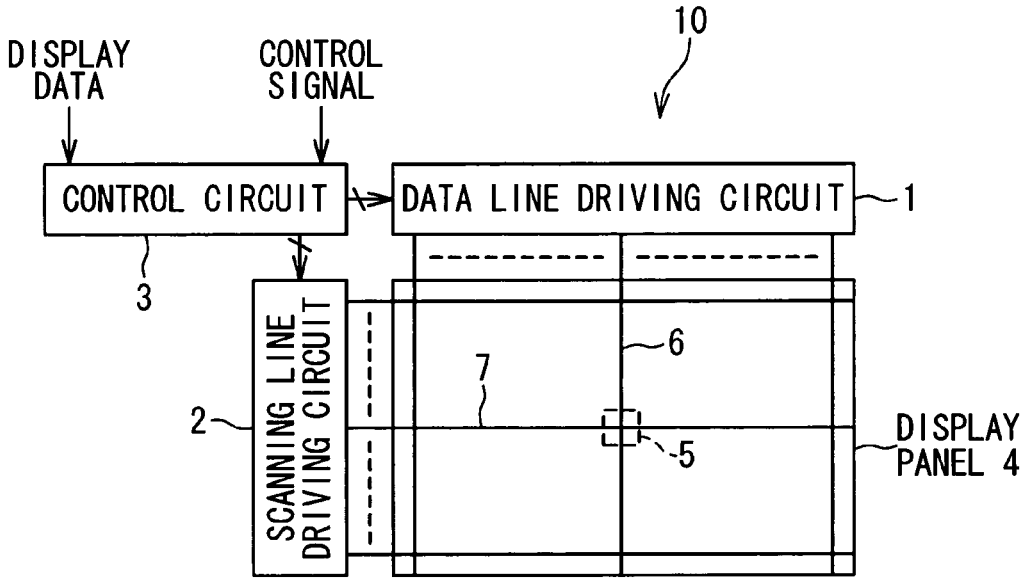
FIG. 5 is a block diagram showing the circuit configuration of a display panel apparatus according to a first embodiment of the present invention.

FIG. 5 is a block diagram showing the circuit configuration of a display panel apparatus according to the first embodiment of the present invention. As shown in FIG. 5, the display apparatus 10 includes a data line driving circuit 1, a scanning line driving circuit 2, a control circuit 3, and a display panel 4. The display panel 4 has a plurality of data lines 6 arranged in a column direction. Each data line 6 is connected with the data line driving circuit 1. Similarly, the display panel 4 has a plurality of scanning lines 7 arranged in a row direction. Each scanning line 7 is connected with the scanning line driving circuit 2. In addition, the display panel 4 has a pixel 5 at each of the intersections of the plurality of data lines 6 and the plurality of scanning lines 7.

The display apparatus 10 shown in FIG. 5 is driven by the sequential line driving method. The scanning line driving circuit 2 drives the plurality of scanning lines 7 in a predetermined order in response to a scanning sync signal. The data line driving circuit 1 drives the plurality of data lines 6 so that the pixels 5 stores the display data in response to the scanning line 7 which is selectively driven by the scanning line driving circuit 2. The data line driving circuit 1 drives the data line 6 in a data line drive period for each pixel to store the display data. The data line drive period is divided into a first period and a second period. The first period is a precharge period and the second periods is a current drive period.

The data line driving circuit 1 and the scanning line driving circuit 2 are connected with the control circuit 3. The data line driving circuit 1 supplies a predetermined voltage or current to the plurality of data lines 6 in response to a driving circuit control signal outputted from the control circuit 3. The scanning line driving circuit 2 supplies a predetermined voltage or current to the plurality of scanning lines 7 as well as the data line driving circuit 1 in response to the driving circuit control signal outputted from the control circuit 3.

The control circuit 3 receives display data to be displayed on the display panel 4 and a control signal corresponding to the display data. The control circuit 3 generates the driving circuit control signal, and outputs the signal to the data line driving circuit 1 and the scanning line driving circuit 2. The display panel 4 has a plurality of pixels 5 in a matrix and displays an image based on the outputs of the data line driving circuit 1 and the scanning line driving circuit 2. The display panel 4 outputs the display data as a display image by driving an electro-luminescent element as a light-emitting element included in each pixel 5.

Figure 6:
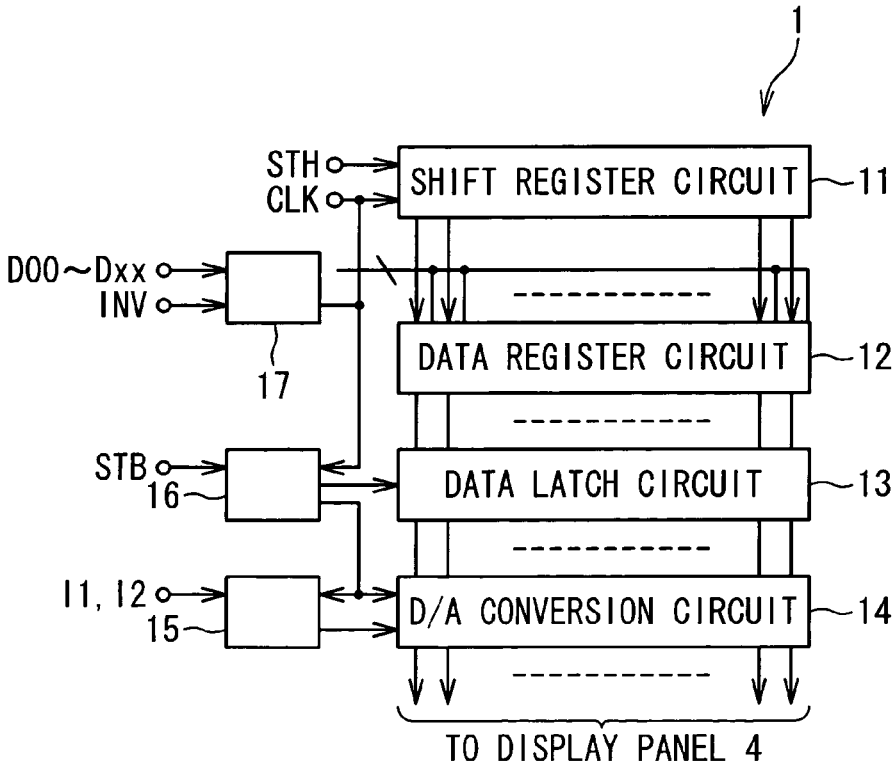
FIG. 6 is a block diagram showing the circuit configuration of a data line driving circuit in the first embodiment.

FIG. 6 is a block diagram showing the circuit configuration of the data line driving circuit 1. As shown in FIG. 6, the data line driving circuit 1 includes a shift register circuit 11, a data register circuit 12, a data latch circuit 13, a D/A conversion circuit 14, a gradation voltage generating circuit 15, a timing control circuit 16, and an input buffer circuit 17. The shift register circuit 11 outputs a sampling signal in response to a horizontal signal STH in synchronism with a clock signal CLK. The input buffer circuit 17 receives the display data, and carries out a bit inversion to the display data based on a control signal INV and then outputs the bit-inverted display data to the data register circuit 12 in synchronism with the clock signal CLK. The data register circuit 12 is a memory circuit to store the display data in synchronism with the sampling signal outputted from the shift register circuit 11. The timing control circuit 16 generates timing control signals in response to a strobe signal STB in synchronism with the clock signal CLK to control the operation of the data latch circuit 13, the D/A conversion circuit 14, and the gradation voltage generating circuit 15. The data latch circuit 13 reads out the display data stored in the data register circuit 12 in synchronism with a latch signal as the timing control signal from the timing control circuit 16 and outputs the latched data to the D/A conversion circuit 14. The gradation voltage generating circuit 15 generates the gradation voltage based on gradation setting data 11 and 12 and outputs the gradation voltage to the D/A conversion circuit 14 in response to the timing control signal from the timing control circuit 16. The D/A conversion circuit 14 converts the digital display data from the data latch circuit 13 into an analog signal based on the gradation voltage supplied from the gradation voltage generating circuit 15 in response to the timing control signal from the timing control circuit. The data lines are driven based on the analog signals.

Figure 7:
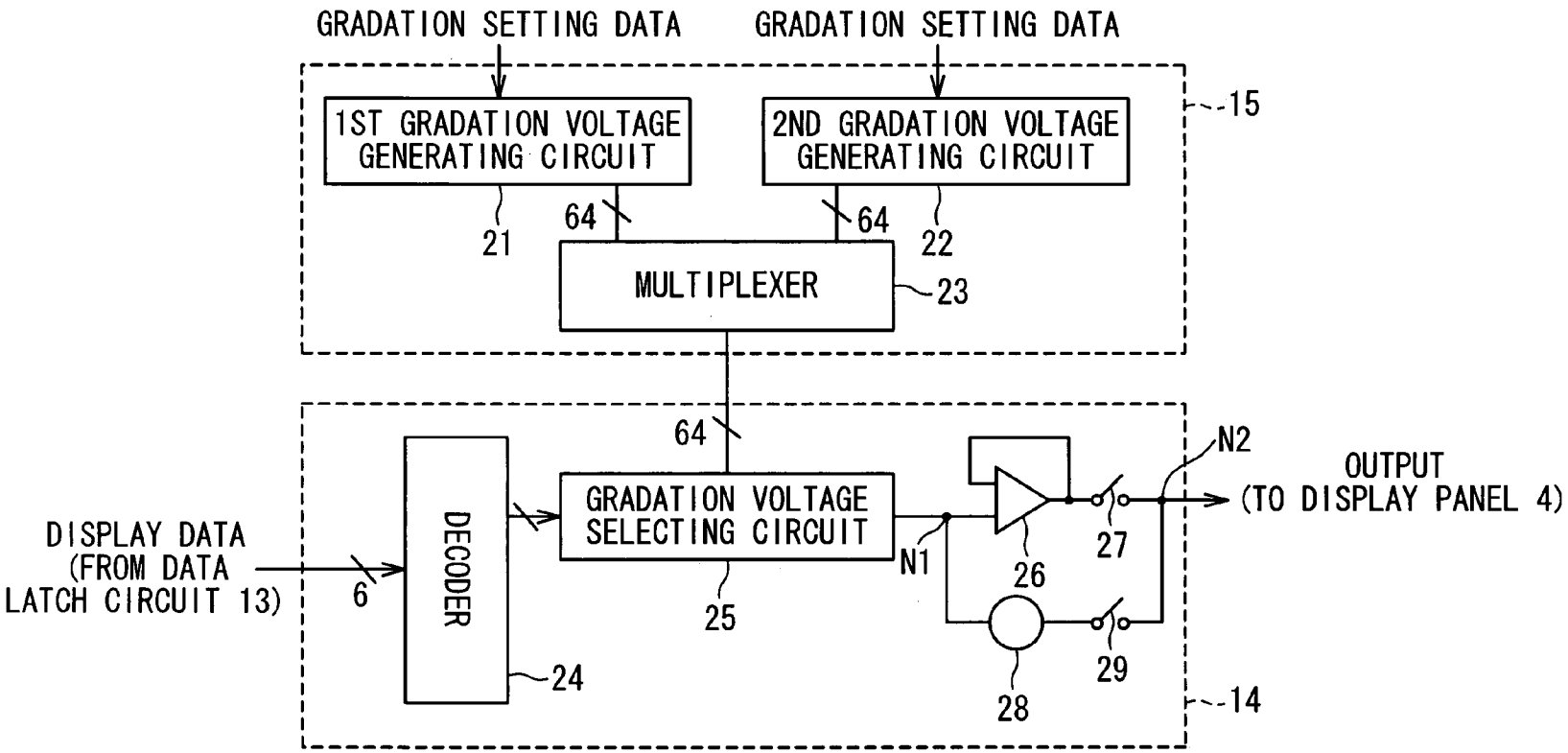
FIG. 7 is a block diagram of the circuit configuration of a D/A conversion circuit and a gradation voltage generating circuit 15 in the first embodiment.

FIG. 7 is a block diagram of the circuit configuration of the D/A conversion circuit 14 and the gradation voltage generating circuit 15 in the first embodiment. The gradation voltage generating circuit 15 a first gradation voltage generating circuit 21 which generates a plurality of first gradation voltages based on the gradation setting data 11, a second gradation voltage generating circuit 22 which generates a plurality of second gradation voltages based on the gradation setting data 12, and a multiplexer 23. The multiplexer 23 outputs one of the plurality of first gradation voltages and the plurality of second gradation voltages as a plurality of gradation voltages to the D/A conversion circuit 14 in parallel in parallel.

As shown in FIG. 7, the D/A conversion circuit 14 includes a decoder 24, a gradation voltage selecting circuit 25, a voltage driver 26, a first switch 27, a current driver 28, and a second switch 29. The decoder 24 is connected with the gradation voltage selecting circuit 25. An output terminal of the gradation voltage selecting circuit 25 is connected with each of input terminals of the voltage driver 26 and current driver 28 through a node N1. An output terminal of the voltage driver 26 is connected with the first switch 27. The first switch 27 is connected with the data line 6 through a node N2. An output terminal of the current driver 28 is connected with the second switch 29. The second switch 29 connected the data line 6 through the node N2.

The decoder 24 decodes the display data for one pixel supplied from the data latch circuit 13 and outputs the decoded data to the gradation voltage selecting circuit 25. The gradation voltage selecting circuit 25 selects a specific gradation voltage from the plurality of gradation voltages supplied from the gradation voltage generating circuit based on the display data supplied from the decoder 24. The gradation voltage selecting circuit 25 outputs the selected data to the voltage driver 26 or the current driver device 28.

The voltage driver 26 can drive a corresponding one of the data lines 6 with high drive ability. For instance, the voltage driver 26 is provided with a voltage follower circuit or a source follower circuit. The voltage driver 26 drives the data line 6 with a voltage corresponding to the voltage supplied from the selecting circuit 25. The current driver 28 can drive the data line 6 with a constant current. Thus, the data line 6 and the pixel 5 are voltage-driven at high speed in the precharge period by the voltage driver 26, and the data line 6 and the pixel 5 are current-driven in a predetermined current in the current drive period by the current driver 28. In the voltage drive, the value and direction of the current flow are both changeable. On the other hand, in the current drive, the current value is constant and the direction of the current flow in not changed.

The gradation voltage selecting circuit 25 selects one of the plurality of first gradation voltages as the plurality of gradation voltages based on the output from the decoder 24. The selected first gradation voltage is subjected to impedance conversion by the voltage driver 26 and is outputted as a precharge voltage. Also, the gradation voltage selecting circuit 25 selects one of the plurality of second gradation voltages as the plurality of gradation voltages based on the output from the decoder 24. The selected second gradation voltage is supplied to the current driver 28. The current converter 28 generates and outputs a drive current by carrying out current conversion to the selected second voltage supplied from the gradation voltage selecting circuit 25. It should be noted that the drive ability of the voltage driver 26 is greatly larger than that of the current driver 28. Therefore, an influence on the precharge voltage is as small as negligible. As a result, the second switch 29 may be omitted from the D/A conversion circuit 14.

Figure 8:
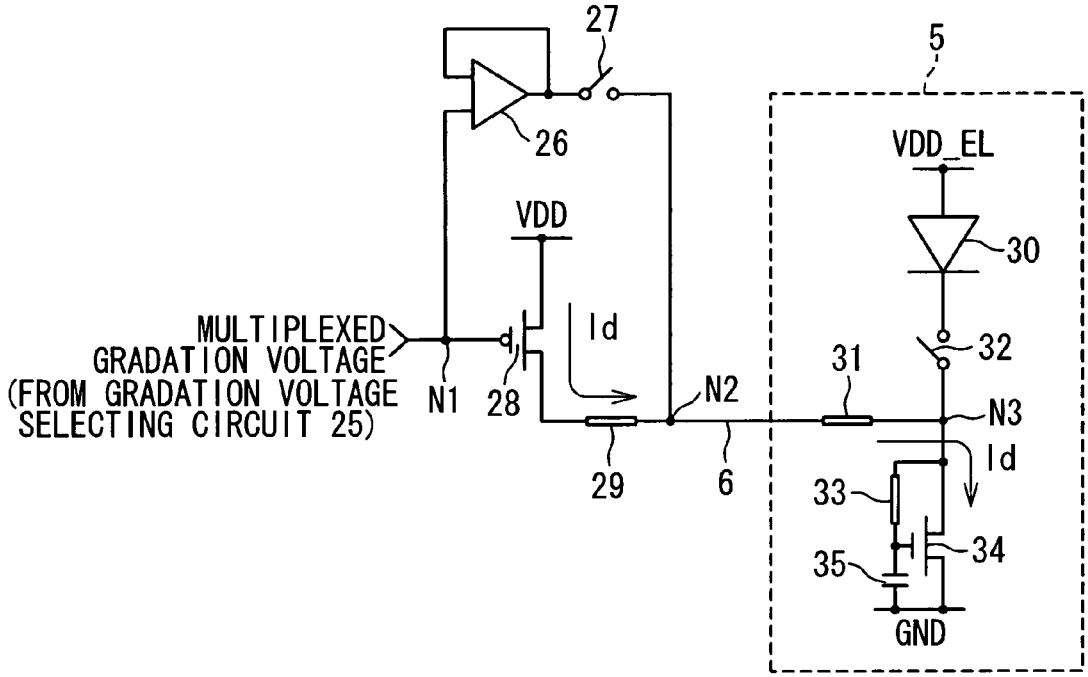
FIG. 8 is a block diagram showing the circuit configurations of a pixel and a current driver connected with the pixel in the first embodiment.

FIG. 8 is a block diagram showing the circuit configurations of the pixel 5 and the current driver 28 connected with the pixel 5 in the first embodiment. As shown in FIG. 8, the pixel 5 in the display panel 4 is connected with the current driver 28 through the data line 6. The pixel 5 includes an electro-luminescent element 30 as a light-emitting element, a plurality of thin film transistors (TFTs) 31 to 34, and a capacitor element 35. The electro-luminescent element 30 emits light through the EL (Electro Luminescence) phenomenon. The first TFT 34 is a driving transistor for the pixel 5 and is configured of a N-channel transistor. The electro-luminescent element 30 is connected with a power supply VDD_EL. The second TFT 32 is connected between the electro-luminescent element 30 and a node N3. The third TFT 31 is connected between the data line 6 and the node N3. The first TFT 34 is connected between the node N3 and the ground potential GND. The capacitor element 35 is connected between the gate of the first TFT 34 and the ground potential GND. The fourth TFT 34 is connected between the node N3 and the gate of the first TFT 34.

The current driver 28 shown in FIG. 8 is configured of a P-channel transistor. The gate of the current driver 28 is connected with the gradation voltage selecting circuit 25 through the node N1. The current driver 28 generates and supplies a current Id to the data line 6 based on the selected second gradation voltage supplied from the gradation voltage selecting circuit 25. The current driver 28 shown in FIG. 8 is configured of a single transistor of the P-channel transistor. This is because the first TFT 34 in the pixel 5 is N-channel transistor. It should be noted that it is desirable that the current driver 28 is configured of the N-channel transistor if the first TFT 34 of the pixel 5 is configured of the P-channel transistor.

Figure 9A:
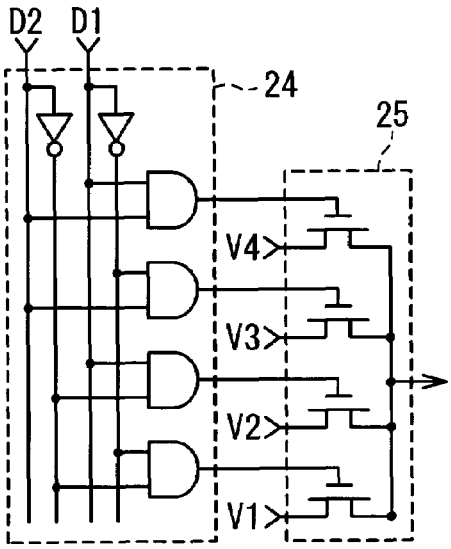
FIGS. 9A and 9B are circuit diagrams showing examples of the configurations of a decoder and a gradation voltage selecting circuit in the D/A conversion circuit in the first embodiment.
Figure 9B:
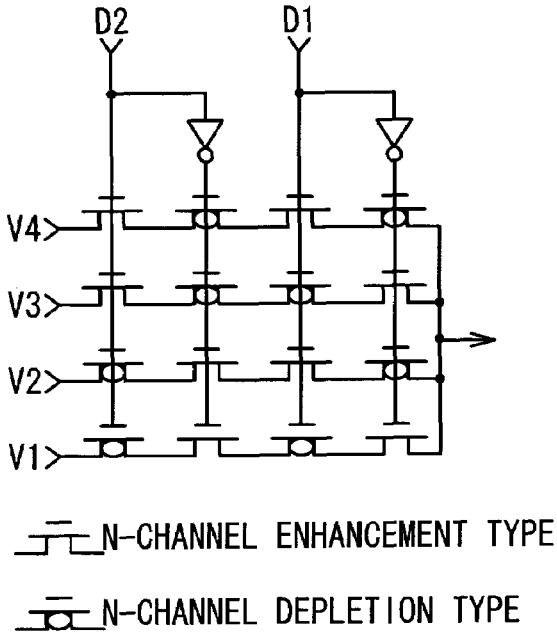

FIGS. 9A and 9B are circuit diagrams showing examples of the configurations of the decoder 24 and the gradation voltage selecting circuit 25 in the D/A conversion circuit 14. FIGS. 9A and 9B shows the examples when the display data is of 2 bits D1 and D2 and the gradation voltages are V1 to V4. FIG. 9A shows a circuit in which the decoder 24 and the gradation voltage selecting circuit 25 are individually configured. FIG. 9B shows a circuit diagram in which the decoder 24 and the gradation voltage selecting circuit 25 are combined. It should be noted that in FIGS. 9A and 9B switches are shown as N-type MOS transistors, but they may be configured of transfer switches of CMOS configuration.

Figure 10:
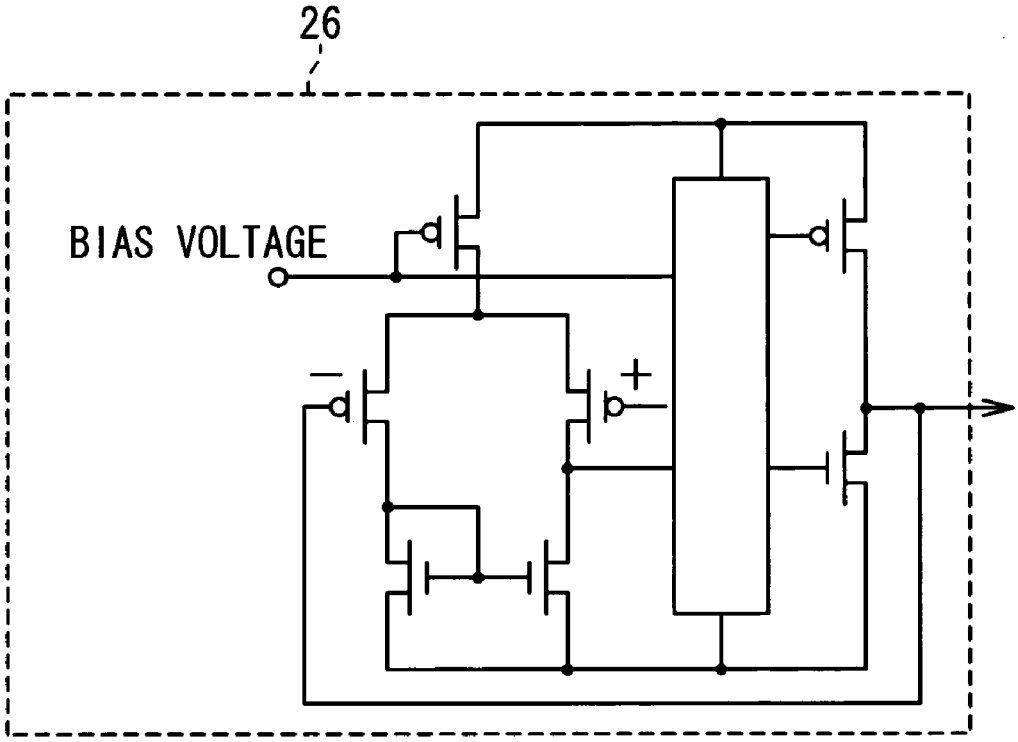
FIG. 10 is a circuit diagram showing the circuit configuration of a voltage driver in the D/A conversion circuit in the first embodiment.

FIG. 10 is a circuit diagram showing the circuit configuration of the voltage driver 26 in the D/A conversion circuit 14. Referring to FIG. 10, an output stage of the voltage driver 26 is of a push-pull type, and differential input transistors are the P-channel transistors because the first TFT 34 of the pixel 5 is the N-channel transistor. If the differential input transistors are the N-channel transistors, the voltage range on the power supply voltage VDD side is narrowed by a threshold voltage Vth. Therefore, it is possible to widen the voltage range in the vicinity of the ground potential by using the P-channel transistors as the differential input transistors.

Although the voltage range can be widened if the differential input transistors are depletion type transistors, this type transistor is not used so much. This is because a deviation in threshold voltage is larger so that a deviation in offset voltage of an amplifier also is larger. However, the depletion type transistors may be used as the differential input transistors in the following case. That is, the deviation in threshold voltage of the first TFT 34 in the pixel 5 is larger by about one digit than that of the depletion type transistor. Also, the first TFT 34 can be driven to a desired current value by the current driver 28 after the data line 6 and the pixel 5 are driven by the voltage driver 26. Therefore, there is no problem in that the depletion type transistors are used for the differential input transistors, if the deviation in the offset voltage is about 0.2V.

Figure 11A:
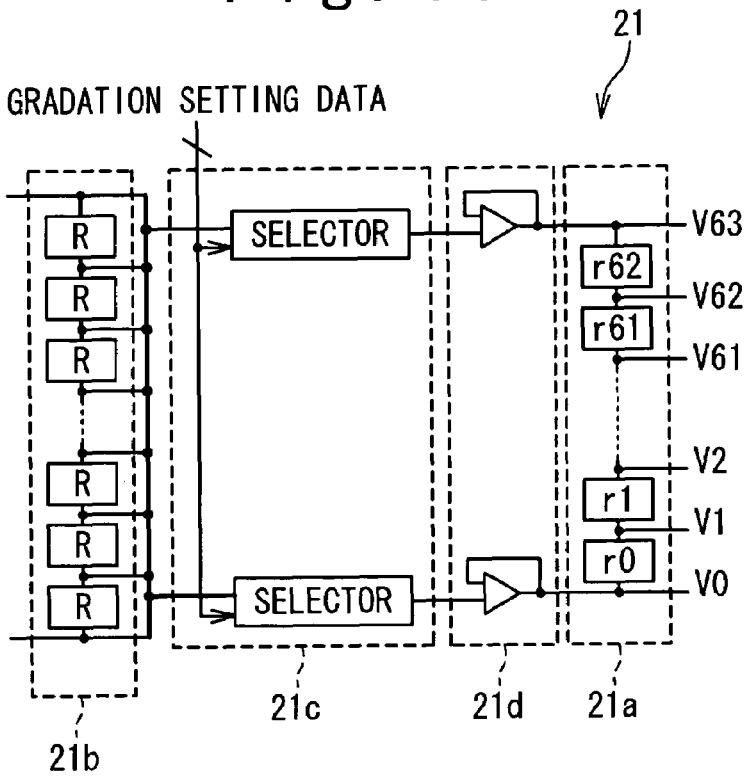
FIG. 11A is a block diagram showing the circuit configuration of a first gradation voltage generating circuit in the first embodiment.

FIG. 11A is a block diagram showing the circuit configuration of the first gradation voltage generating circuit. As shown in FIG. 11A, the first gradation voltage generating circuit 21 includes a resistance string circuit 21*a*, a reference voltage generating circuit 21*b*, a selector circuit 21*c*, and a voltage follower circuit 21*d*. In the resistance string circuit 21*a*, a plurality of resistances r0 to r62 are connected in series. Desired gradation voltages V0 to V63 are outputted from each node of the resistance string circuit 21*a* to the multiplexer 23. The reference voltage generating circuit 21*b* generates voltages based on the gradation setting data. For instance, the reference voltage generating circuit 21*b* generates and outputs two hundred and fifty six voltages in an equal interval by resistances R, having the same resistance, of two hundred and fifty six when the gradation setting data is 8 bits data. The selector circuit 21*c* selects two arbitrary voltages based on the gradation setting data. The arbitrary two voltages selected by the selector circuit 21*c* are supplied to the voltage follower circuit 21*d*. The voltage follower circuit 21*d* carries out impedance conversion and generates two reference voltages based on the arbitrary two voltages. The voltage follower circuit 21*d* applies the reference voltages from the selector circuit 21*c* to both ends of the resistance string circuit 21*a*. The first gradation voltage generating circuit 21 may be configured to include an external circuit of the reference voltage generating circuit 21*b*, the selector circuit 21*c*, and the voltage follower circuit 21*d*. At this time, two reference voltages are supplied from the external circuit to the both ends of the resistance string circuit 21*a*. In the first gradation voltage generating circuit 21 which generates the plurality of first gradation voltages, the values of 63 resistances of the resistance r0 to r62 are set in such a manner that a desired voltage can be obtained, considering characteristic of an current Id-voltage Vg of the first TFT 34 in the pixel 5 and an ON-resistance value of the third TFT 31.

Figure 11B:
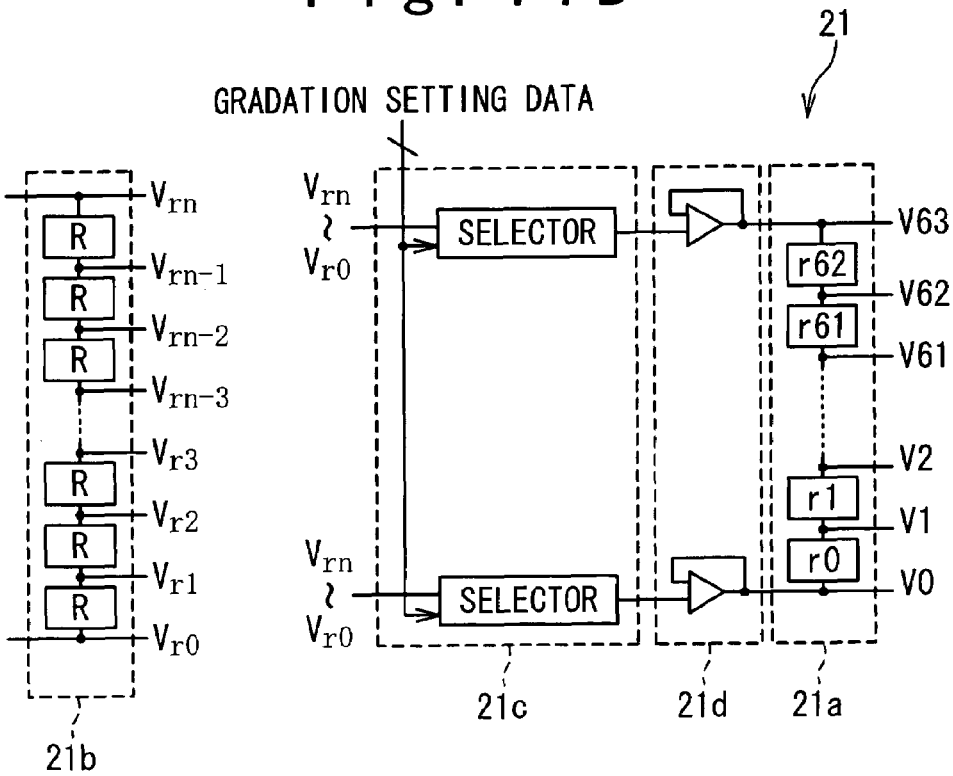
FIG. 11B is a block diagram showing the connection of the respective function blocks in the first gradation voltage generating circuit.

FIG. 11B is a block diagram showing the connection of the respective function blocks in the first gradation voltage generating circuit 21. As shown in FIG. 11B, the reference voltage generating circuit 21*b* and the selector circuit 21*c* are connected with each other such that voltage signals $Vr_0$ to $Vr_n$, (n is an arbitrary natural number) outputted from the reference voltage generating circuit 21*b* are supplied to each of selectors in the selector circuit 21*c*.

Figure 12A:
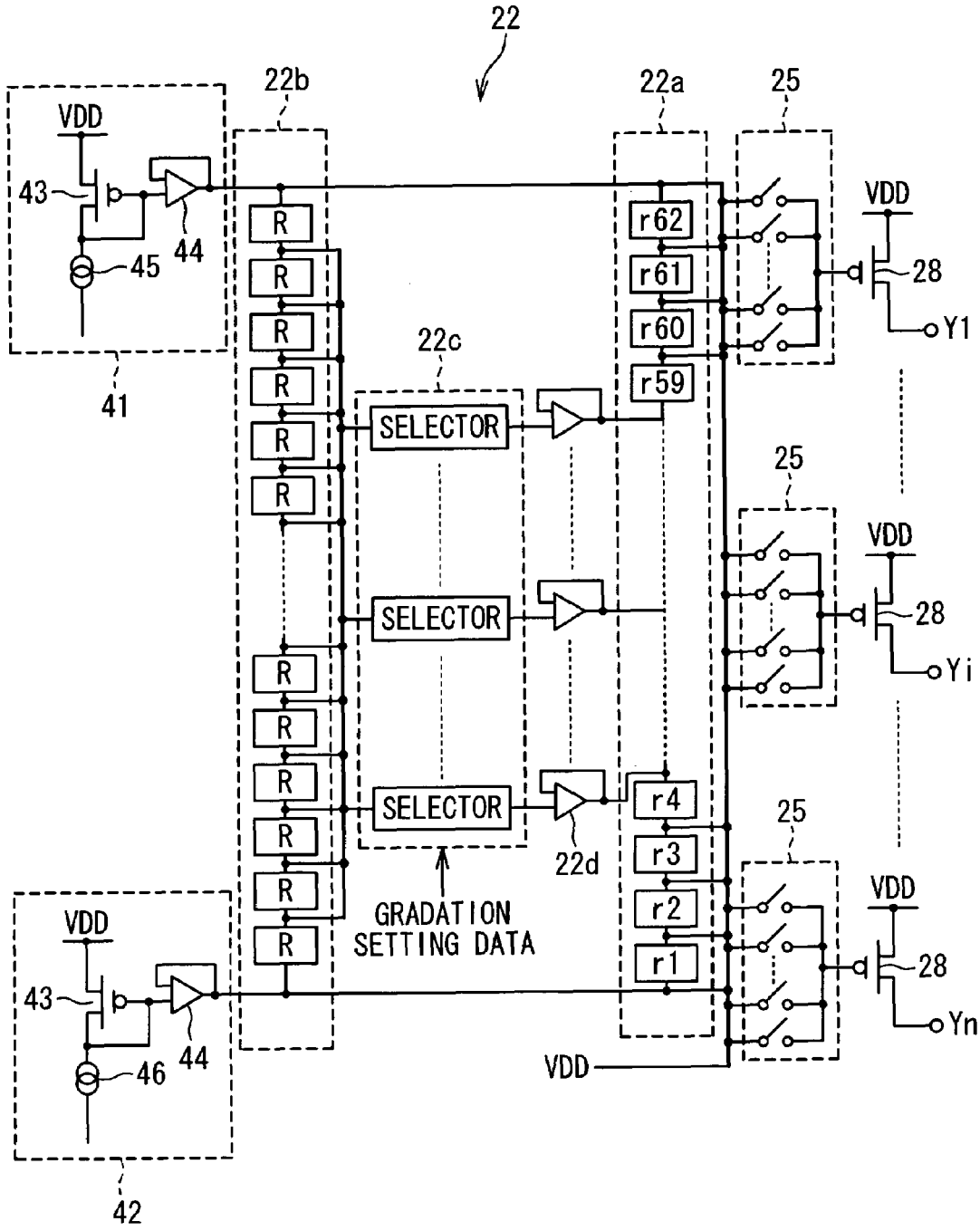
FIG. 12A is a circuit diagram showing the circuit configuration of a second gradation voltage generating circuit in the first embodiment.

FIG. 12A is a circuit diagram showing the circuit configuration of the second gradation voltage generating circuit 22. As shown in FIG. 12A, the second gradation voltage generating circuit 22 includes a resistance string circuit 22*a*, a reference voltage generating circuit 22*b*, a selector circuit 22*c*, and a voltage follower circuit 22*d*, similarly to the first gradation voltage generating circuit 21. In the resistance string circuit 22*a*, 62 resistances r1 to r62 are connected in series such that desired gradation voltage Vc1 (in the first gradation level) to Vc63 (the 63-th gradation level) are outputted from each node. The gradation voltage Vc0 (0-th gradation level) is used as the ground potential of the current driver 28, because the current value supplied from the current driver 28 is 0 [A]. The resistance string circuit 22*a* is connected with the gradation voltage selecting circuit 25 through the multiplexer 23. In addition, the second gradation voltage generating circuit 22 includes a first voltage generating circuit 41 and a second voltage generating circuit 42. The first voltage generating circuit 41 has a voltage generation transistor 43, a voltage follower 44, and a first current source 45. The second voltage generating circuit 42 includes a voltage generation transistor 43, a voltage follower 44, and a second current source 46, like the first voltage generating circuit 41. It is preferable that each of the voltage generation transistors 43 included in the first voltage generating circuit 41 and the second voltage generating circuit 42 has the same conductive type and size as the transistor in the current driver 28. Referring to FIG. 12A, the source of the voltage generation transistors 43 is connected with power supply voltage VDD, and the drain thereof is connected with the current source 45 or 46. The gate and the drain of the voltage generation transistor 43 are short-circuited and are connected with an input of the voltage follower 44.

Figure 12B:
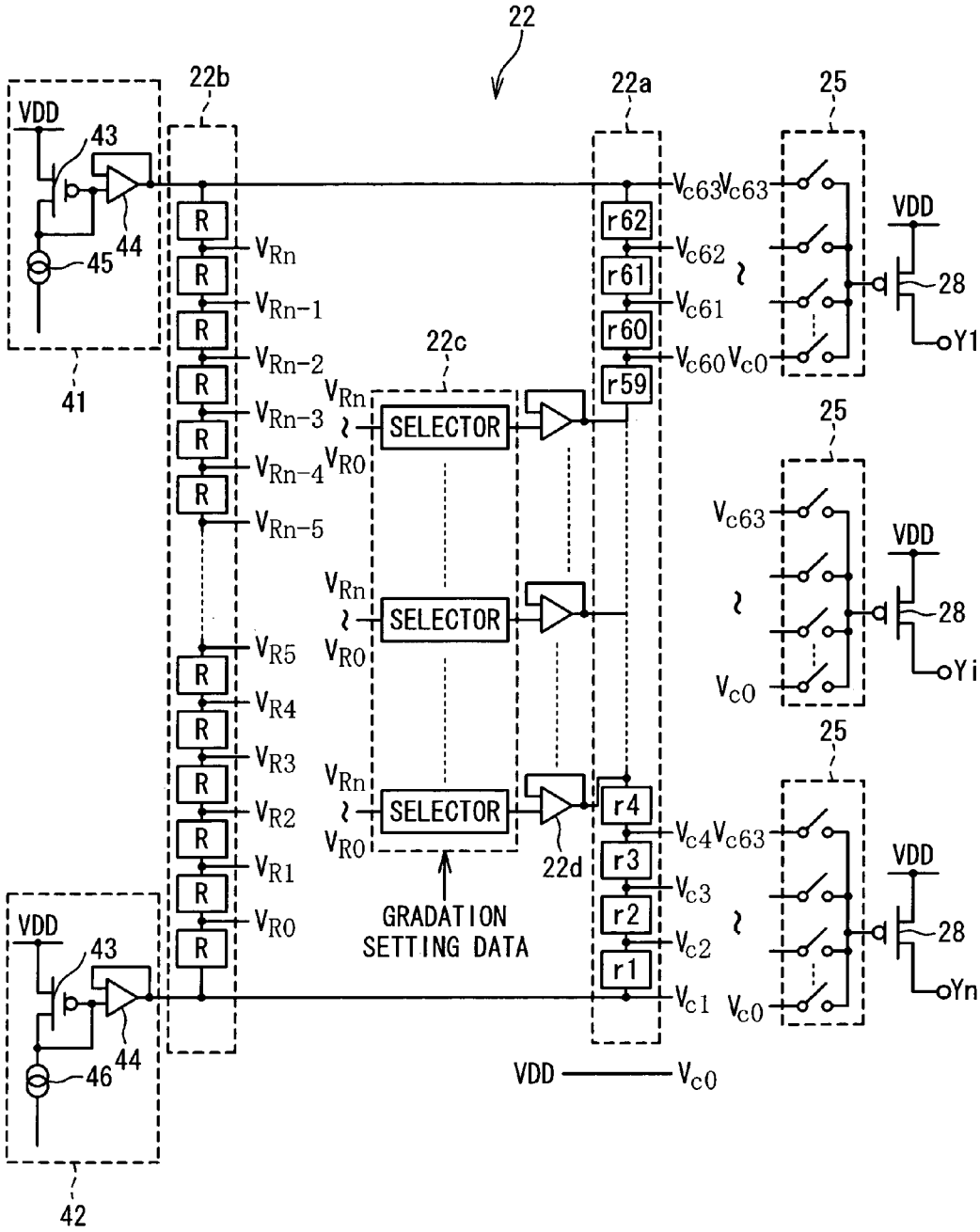
FIG. 12B is a circuit diagram showing the connection of the respective function blocks in the second gradation voltage generating circuit.

FIG. 12B is a circuit diagram showing the connection of the respective function blocks in the second gradation voltage generating circuit 22. As shown in FIG. 12B, the reference voltage generating circuit 22*b* and the selector circuit 22*c* are connected with each other such that voltages $Vr_0$ to $Vr_n$, (n is an arbitrary natural number) outputted from the reference voltage generating circuit 22*b* are supplied to each of selectors in the selector circuit 22*c*. Also, the resistance string circuit 22*a* and each of a plurality of gradation voltage selecting circuits 25 are connected with each other such that at least one of voltages $Vc_0$ to $Vc_{63}$, and $V_{DD}$ outputted from the resistance string circuit 22*a* is supplied to the gradation voltage selecting circuit 25. The voltage generated by the voltage generating circuit 41 or 42 is based on the current value of the first current source 45 or the second current source 46. Here, if the voltage generation transistor 43 and the transistors of the current drivers 28 are formed on the same substrate, the threshold voltages of the transistors can be almost same. For this reason, the deviation in the threshold voltage among the current drivers 28 can be eliminated.

The first voltage generating circuit 41 generates the voltage corresponding to a maximum brightness (63-th gradation level). The second voltage generating circuit 42 generates the voltage corresponding to a minimum brightness (first gradation level), which is the lowest value and not a non-display (0-th gradation level). In case of the non-display (0-th gradation level), the current of current driver 28 is 0, and the minimum voltage is sufficient to be less than the threshold voltage of the transistor of the current driver 28. Therefore, the source voltage is supplied which is the same potential as the power supply voltage VDD in case of the P-channel transistor, and the same potential as ground potential GND in case of the N-channel transistor.

In order to generate the voltage corresponding to the minimum brightness (first gradation level), the current value of the second source current 46 is set based on the gradation setting data. The gate voltage generated based on the current flowing through the voltage generation transistor 43 is subjected to impedance conversion by the voltage follower 44. Similarly, in order to generate the voltage corresponding to the maximum brightness (63-th gradation level), the current value of the first source current 45 is set based on the gradation setting data. The gate voltage generated based on the current flowing through the voltage generation transistor 43 is subjected to impedance conversion by the voltage follower 44. The second gradation voltage generating circuit 22 generates the voltages corresponding to the maximum and minimum brightness, a difference between which is divided by the resistance string circuit 22*a* to generate the plurality of second gradation voltages adaptive for the gamma characteristic. The selector circuit 22*c* and the voltage follower circuit 22*d* is a finely adjusting circuit for the gamma characteristic.

The relation between the input signal and the brightness is such as (brightness)=(input signal)$^{\gamma}$. The gamma value $\gamma$ is set as $\gamma$=2.2 in NTSC or $\gamma$=1.8 in Macintosh. In order to make the voltage generated by the second gradation voltage generating circuit 22 adaptive for both $\gamma$=2.2 and $\gamma$=1.8, it is preferable that the resistance values of the resistance string 22*a* is set so as to be $\gamma$=2.0 and then the generated voltages are finely adjusted. For instance, the current Id-voltage Vg characteristic of the current driver 28 is $Id=k(Vg-Vt)^2$. For $\gamma$=2.0, the resistances r1 to r62 are set to same. The gamma correction is carried out by the selector circuit 22*c* and the voltage follower circuit 22*d* and the above-mentioned voltages are finely adjusted so that the gradation voltage adaptive for the gamma characteristic can be obtained. Moreover, when the gamma characteristic is different for each of RGB colors, the second gradation voltage generating circuit 22 generates the gradation voltages adaptive for the gamma characteristic for each color.

Figure 13:
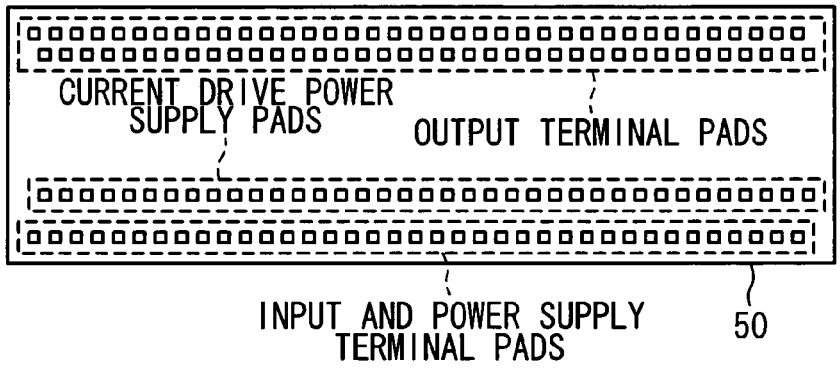
FIG. 13 shows a diagram showing the arrangement of rows of connection pads of power supply for the source voltage of the current driver.

FIG. 13 shows a diagram showing the arrangement of rows of connection pads 50 of the power supply for the source voltage of the current driver 28. As shown in FIG. 13, in the arrangement of the rows of connection pads 50, a plurality of rows of the current driver power supply pads are provided between a row of input and power supply terminal pads and a row of output pads in parallel in a row direction. In the display apparatus 10 of the first embodiment, a gradation current Id is generated by controlling the gate voltage Vg of the transistor of the current driver 28, and is $$Id=k(Vg-Vt)^2 \text{ (k is a proportion constant)}$$

The gate voltage Vg is a voltage from the power supply voltage as the source voltage. The deviation in current occurs when the power supply voltages are different for every current driver. It is supposed that the current driver power supply pad is one and the current of 100 μA is supplied to each of 240 current drivers. In this case, when the wiring resistance from the power supply line to each current driver is 0.1 Ω, there is voltage drop of 0.1 Ω*100 μA*240=2.4 mV. This value corresponds to the voltage difference of 1 or 2 gradation levels in 256 gradation levels. A data line drive IC is connected on a glass substrate in small display apparatus such as cellular phones. In this case, because the connection resistance between the glass substrate and the IC is as high as about 100 Ω per one pad, a plurality of pads are required. By adopting such a configuration of the power supply connection pads for the source voltage of the current driver 28, the deviation in current which is caused by the power supply voltage change of the current driver 28 can be restrained.

Figure 14:
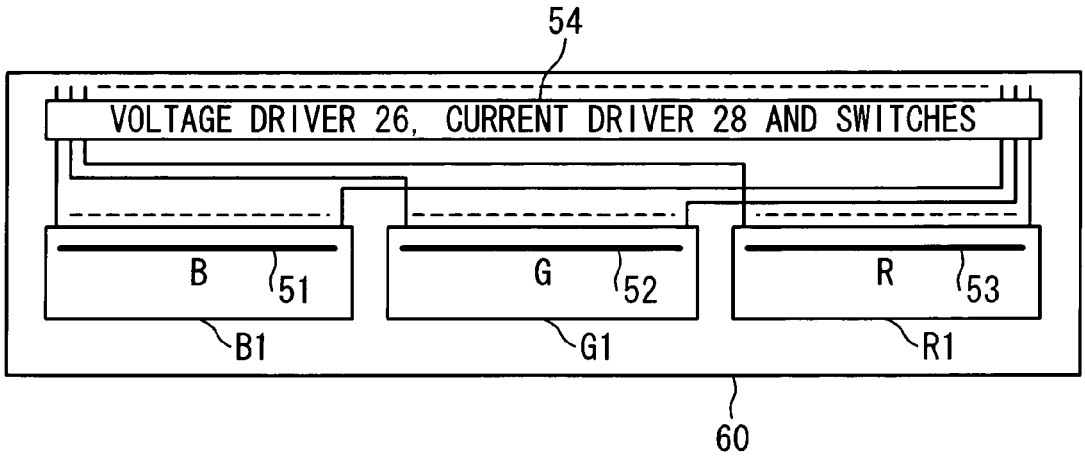
FIG. 14 is a block diagram showing an arrangement of each circuit of the data line driving circuit.

FIG. 14 is a block diagram showing an arrangement of each circuit (11 to 17) of the data line driving circuit 1. As shown in FIG. 14, the arrangement 60 is configured of a B (blue) area B1, a G (green) area G1, an R (red) area R1 and a first specific area 54. The B (blue) area B1 corresponds to pixels 5 which output the B (blue) color of the plurality of pixels 5 of the display panel. Similarly, the G (green) area G1 corresponds to the pixels 5 which output the G (green) color, and the R (red) area R1 corresponds to the pixels 5 which output the R (red) color. A B wiring 51 included in the B (blue) area B1 indicates a wiring for the gradation voltage for the B (blue) color. Similarly, a G wiring 52 indicates a wiring for the gradation voltage for the G (green) color, and an R wiring 53 indicates a wiring for the gradation voltage for the R (red) color.

The different gamma correction is carried out for each of the RGB colors in an organic electro-luminescence display apparatus. Therefore, the gamma correction can be appropriately carried out by grouping the functional blocks in a unit of each of the RGB colors. FIG. 14 shows an arrangement in a region 60, in which each of the shift register circuit 11, the data register circuit 12, the data latch circuit 13, the decoder 24, the gradation voltage selecting circuit 25, and the gradation voltage generating circuit 15 is separately provided for each of the RGB colors. On the other hand, it is preferable that the voltage driver 26, the current driver 28, and the plurality of switches 27 and 29 are not separately provided for each of the RGB colors but are provided in a single area 54 for all the colors, to decrease a parasitic capacitance of the output terminal. Such an area arrangement contributes to an arrangement of the gradation wirings. For instance, when the display data has eight bits (256 gradation levels), the number of gradation wirings is 256. Therefore, if the gradation wirings are provided in each RGB color, an area for 768 wirings is needed so that the arrangement of the gradation wirings is complex. According to the arrangement shown in FIG. 14, the B wirings 51 of the B area, the G wirings 52 of the G area, and the R wirings 53 of the R area are separates each other without intersecting. Therefore, the gradation wiring area can be arranged easily. Thus, the semiconductor device can be configured being reduced the chip size.

Figure 15:
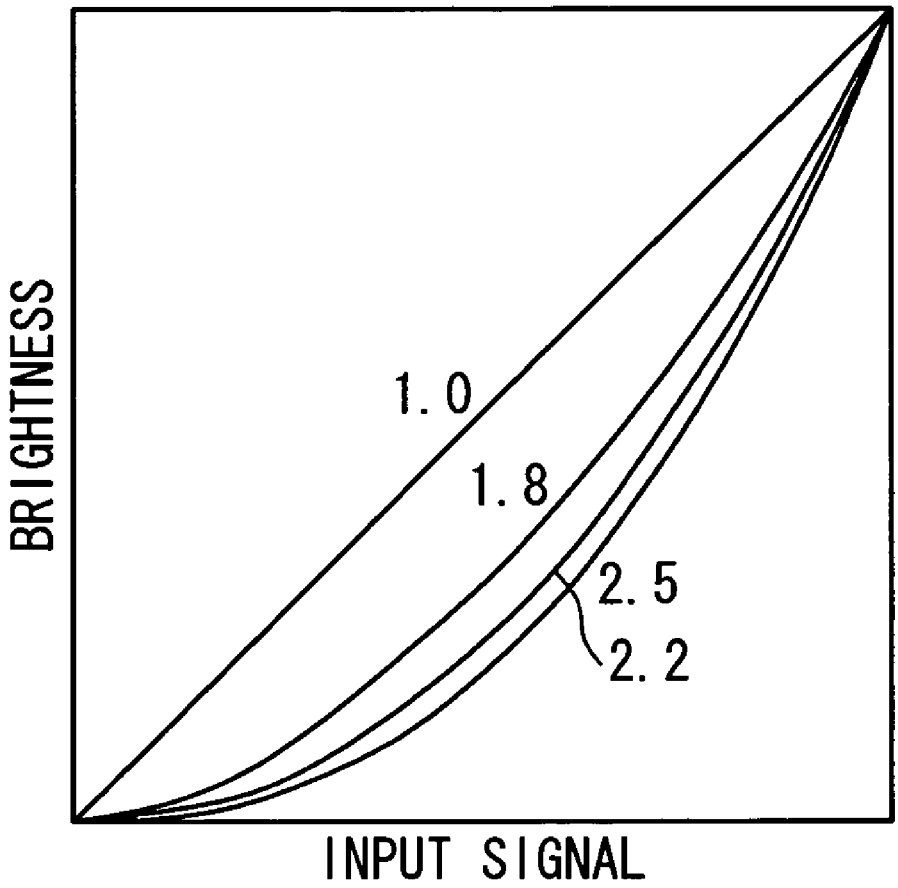
FIG. 15 shows a brightness (current)-gradation characteristic having a gamma characteristic.

FIG. 15 shows a brightness (current)-gradation characteristic having the gamma characteristic. In the current (brightness)-gradation characteristic having the gamma characteristic as shown in FIG. 15, the resolution of ten bits or more is needed in a low current range under the condition that the maximum current value is 1, the lower current range is 0 to ⅓, the middle current range is ⅓ to ⅔, and the high current range is ⅔ to 1. For instance, when the input signal has 6 bits (64 gradation levels), $\gamma$=2.2 and the maximum brightness is 1, each gradation level can be expressed as follow. That is, 0-th gradation level: 0, First gradation level: $(1/63)^{2.2}$=0.0001 which is approximated to 0, Second gradation level: $(2/63)^{2.2}$=0.0005 which is approximated to 0.0004, and Third gradation level: $(3/63)^{2.2}$=0.0012, and further 61-th gradation level: $(61/63)^{2.2}=0.93149$ which is approximated to 0.932, 62-th gradation level: $(62/63)^{2.2}=0.96541$ which is approximated to 0.964, and 63-th gradation level (maximum brightness): $(63/63)^{2.2}=1$.

In this way, the resolution of 11 bits ($2^{11}=2048$) is required because the resolution of about 0.0004 is required in the lower current range.

In the range from the middle current range to the high current range, the resolution of about 0.004 is acceptable, and the gradation can be expressed in the resolution of 8 bits ($2^8=256$). As shown in FIG. 7, as the γ approaches to 1, the resolution may be reduced lower. In case of γ=2.0, the resolution in the lower current range may be about 10 bits, and in case of γ=2.5, the resolution of 12 bits or more is required.

FIG. 16 is a table showing the correspondence of the gradation setting data and the gamma value. As shown in FIG. 16, the resistances r1 to r62 of the second gradation voltage generating circuit 22 shown in FIG. 12A or FIG. 12B may be the same resistance in case of the gamma value of γ=2.0. In case of the gamma value other than γ=2.0, the voltage is adjusted based on the gradation setting data by the selector circuit 22*c* so as to be adaptive to the desirable gamma characteristic.

Figure 17:
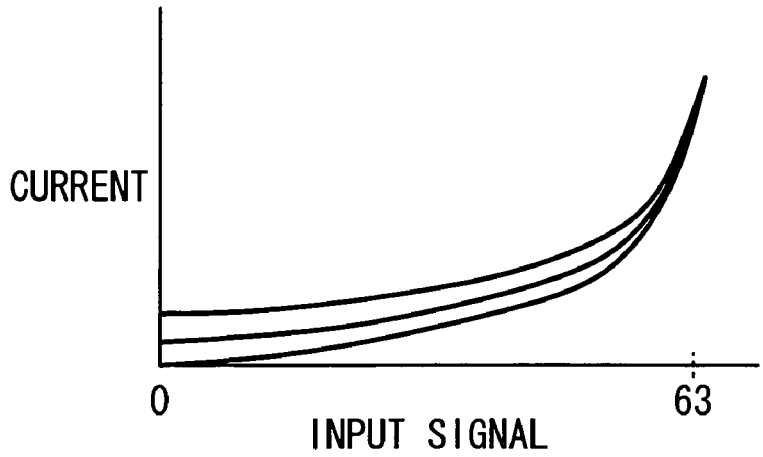
FIG. 17 is shows a gamma curve when the setting of the first voltage generating circuit is changed in the second gradation voltage generating circuit.
Figure 18:
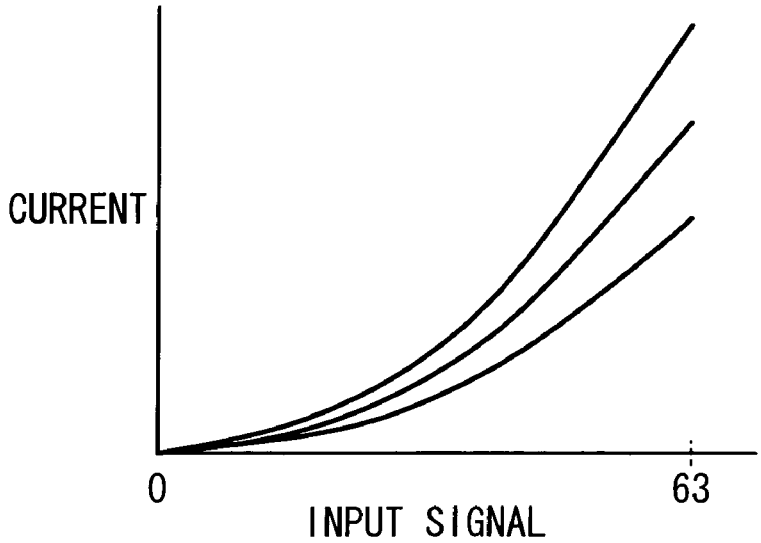
FIG. 18 shows the brightness (current)/gradation characteristic upon changing the setting of the second voltage generating circuit in the second gradation voltage generating circuit.

FIG. 17 is shows a gamma curve when the setting of the first voltage generating circuit 41 is changed in the second gradation voltage generating circuit 22 shown in FIG. 12A or FIG. 12B. As shown in FIG. 17, the gamma curve can be changed by changing the setting of the first voltage generating circuits 41. FIG. 18 shows brightness (current)/gradation characteristic upon the changing the setting of the second voltage generating circuit 42 in the second gradation voltage generating circuit 22. As shown in FIG. 18, the gamma curve can be changed by changing the setting of the second voltage generating circuits 42. In addition, the gamma curve can be changed by changing the setting of the selector circuit 22*c* in the second gradation voltage generating circuit 22.

Figure 19:
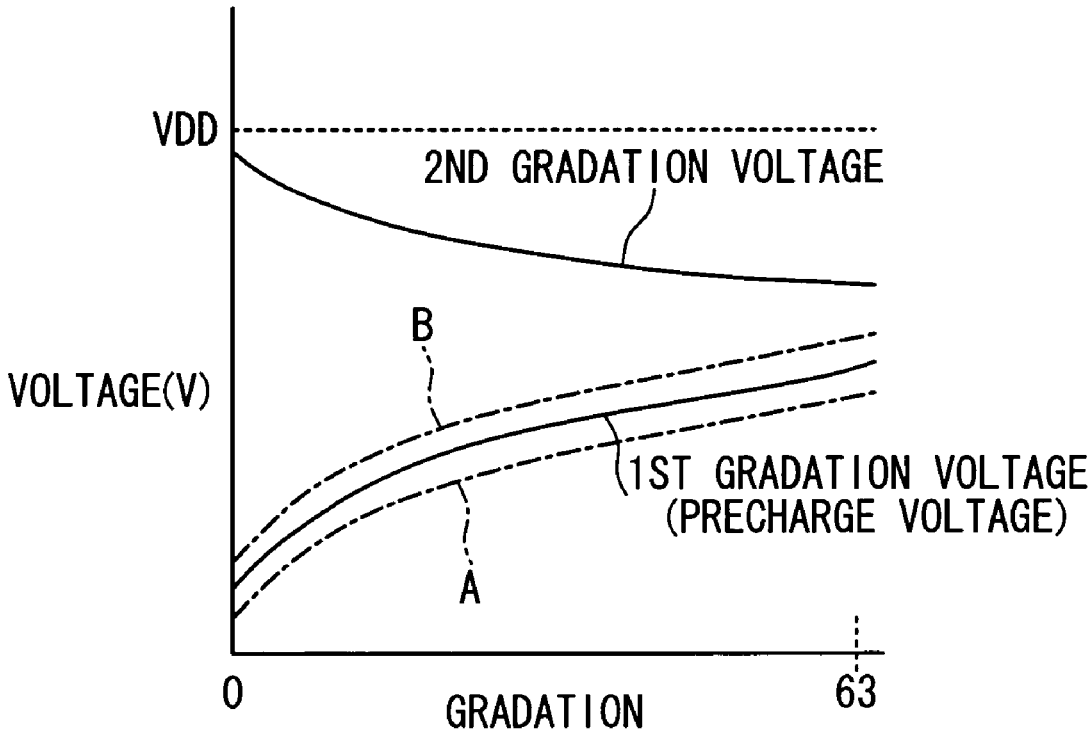
FIG. 19 shows voltage characteristic of the gradation setting upon setting of the plurality of first gradation voltages and second gradation voltages.
Figures 20A, 20B, 20C, 20D:
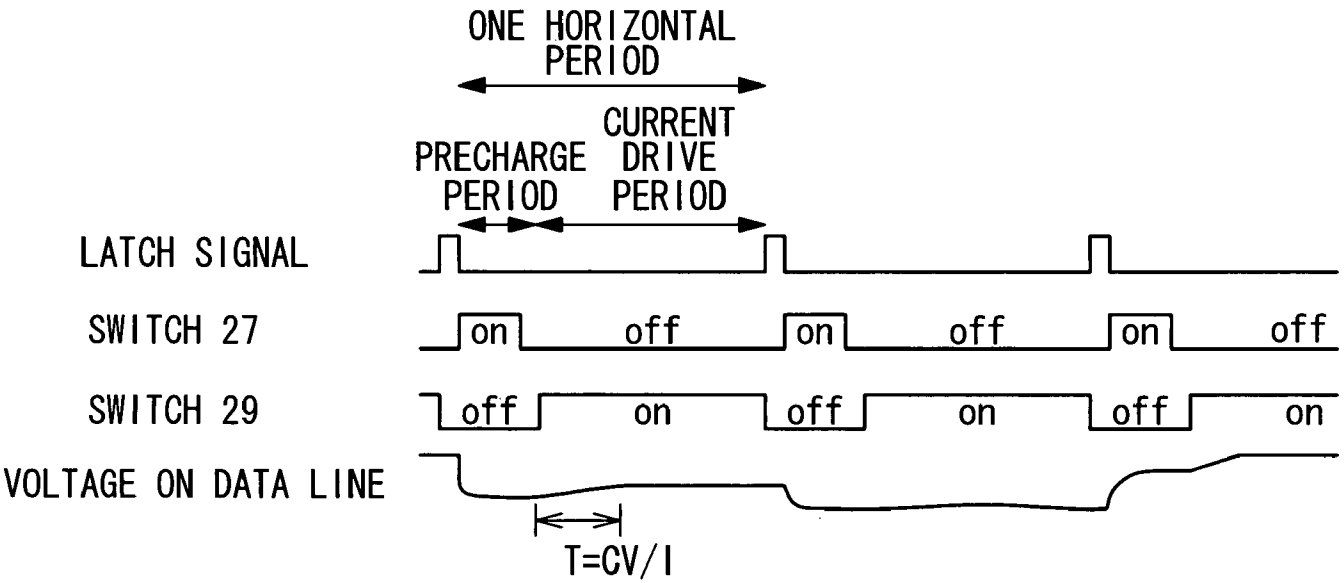
FIGS. 20A to 20D are timing charts showing an operation in the first embodiment.

FIG. 19 shows voltage characteristic of the gradation setting upon the setting of the plurality of first gradation voltages and the second gradation voltages. A curve A shows an initial value of an input signal (gradation)/voltage characteristic of the pixel 5. A curve B shows an input signal/voltage characteristic of the pixel 5 after tens of thousands of hours passed. A time during which the third TFT 31 in the pixel 5 is turned on can be shown as a value of 1/(the number of scanning lines). Here, the threshold voltage of the TFT changes by about 1V in the tens of thousands of hours. This is because the current flows through the first TFT 34 for almost all the periods, and the deterioration speed is fast. Therefore, it is desirable to set the precharge voltage in consideration of the deterioration of the first TFT 34. That is, it is desirable to approximately set the precharge voltage to an average of the values indicated by the curve A and the curve B. Thus, an appropriate gradation setting can be carried out.

As mentioned with reference to FIG. 8, when the first TFT 34 is the N-channel transistor, the current driver 28 is configured of the P-channel transistor. In this case, the first gradation voltage becomes a voltage in the neighborhood of the lower power supply voltage, and the second gradation voltage becomes a voltage in the neighborhood of the higher power supply voltage. Moreover, when the first TFT 34 is the P-channel transistor, the current driver 28 is configured of the N-channel transistor. In this case, the first gradation voltage becomes a voltage in the neighborhood of the higher power supply voltage and the second gradation voltage becomes a voltage in the neighborhood of the lower power supply voltage.

It is desirable to manufacture the data line driving circuit 1 on the silicon substrate because the deviation in characteristic of the transistor on the silicon substrate is superior to the deviation in characteristic of the TFT formed on the glass substrate by about one digit. The data line driving circuit 1 can precharge the pixel to an average of a voltage in the initial characteristic and a voltage in the deteriorated characteristic, independently from the gradation current. Also, the initial value of the precharge may be set to the initial characteristic (the curve A). In this case, the gradation voltage set by the gradation voltage generating circuit 15 should be changed according to a time-based variation in the characteristic of the pixel 5. Thus, an appropriate gradation setting can be carried out.

The data latch circuit 13 is included in the data line driving circuit 1 in the description of the embodiment. However, the configuration of the data line driving circuit 1 is not limited to this in the present invention. For instance, the effect of the present invention can be accomplished even in the following configuration. That is, a frame memory is built into the data line driving circuit 1, and the display data for one line is outputted from the frame memory to the data register circuit 12 all together, so that the display data is stored in the data register circuit 12.

FIGS. 20A to 20D are timing charts showing an operation in the first embodiment. The timing charts shown in FIGS. 20A to 20D show a driving operation of the data line driving circuit 1. The display apparatus 10 is driven by the sequential line driving scanning method as mentioned above. Therefore, the data line driving circuit 1 drives the plurality of data lines 6 in response to the scanning of the plurality of scanning lines. In other words, each data line 6 is driven sequentially at the each scanning (a period during which each data line 6 is driven in response to the scanning of one scanning line is referred as a data line drive period). When each data line is driven, the data line driving circuit 1 divides the data line drive period into a first period (the precharge period) and a second period (the current drive period). Here, the timing control circuit 16 controls the operation timings of the data latch circuit 13, the D/A conversion circuit 14, and the gradation voltage generating circuit 15 as mentioned above in response to the clock signal CLK and a horizontal sync signal. In the following description of the operation, the timing control circuit 16 is assumed to generate the timing control signals corresponding to the above-mentioned precharge period and current drive period. Moreover, the input buffer circuit 17 carries out a bit inversion of the display data in response to the clock signal CLK and the inversion control signal.

As shown in FIGS. 20*a* to 20D, the multiplexer 23 of the gradation voltage generating circuit 15 outputs the plurality of first gradation voltages generated by the first gradation voltage generating circuit 21 to the D/A conversion circuit 14 in the precharge period in response to the timing control signal supplied from the timing control circuit 16. Moreover, the data latch circuit 13 outputs the latched display data to the D/A conversion circuit 14 in response to the timing control signal.

The D/A conversion circuit 14 turns on the first switch 27 in response to the timing control signal supplied from the timing control circuit 16. Also, the D/A conversion circuit 14 activates the voltage driver 26 to carry out impedance conversion to the first gradation voltage outputted from the gradation voltage selecting circuit 25. The first gradation voltage which has been subjected to the impedance conversion is supplied to the corresponding data line 6 through the node N2, and drives the data line 6 up to a desired voltage at high speed. It takes time of about 5 μsec as the precharge period for the data line driving circuit 1 to drive each data line 6. In addition, it is also possible to make the precharge period short in correspondence to the first gradation voltage supplied to the data line 6. The data line driving circuit 1 recognizes a rest in the one data line drive period as an current drive period and controls the current driver 28 to drive the data line 6 in the current drive period. In the current drive period, the multiplexer 23 of the gradation voltage generating circuit 15 outputs the plurality of second gradation voltages, which are generated by the second gradation voltage generating circuit 22, to the D/A conversion circuit 14 in response to the timing control signal supplied from the timing control circuit 16. The D/A conversion circuit 14 receives the timing control signal, and turns the first switch 27 off and turns the second switch 29 on in synchronism with the timing control signal. Moreover, the D/A conversion circuit 14 blocks off a bias current to the voltage driver 26 in synchronism with the timing control signal so as to set the voltage driver 26 to an inactive state. Therefore, the second gradation voltage outputted from the gradation voltage selecting circuit 25 is supplied to the current driver 28. The current driver 28 generates a gradation current to be supplied to the data lines 6 based on the second gradation voltage and drives a corresponding one of the data lines 6 with the generated gradation current. For instance, because the driving time of each data line is about 50 μsec when the number of pixels of the display apparatus follows the QVGA specification and the frame cycle is 60 Hz, the driving time of the current driver 28 is about 45 μsec. Also, the power consumption can be reduced by blocking off the bias current to the voltage driver 26 in the current drive period so that the voltage driver 26 is set to the inactive state. The gradation current generated by the current driver 28 is determined based on the current Id/voltage Vg characteristic of the transistor of the current driver 28. However, the voltage drop occurs in the power supply line when the current flows from the current driver 28 to the power supply line VDD (or the ground potential GND), which causes a deviation in current. The deviation in current in the current driver 28 can be retrained by blocking off an unnecessary current such as the bias current to the voltage driver 26. Therefore, the image quality can be improved.

It should be noted that the plurality of first gradation voltages generated by the first gradation voltage generating circuit 21 are determined based on an ON-resistance of the third TFT 31 in the pixel 5 and the current Id/voltage Vg characteristic of the first TFT 34. For instance, it is supposed that the characteristics of the voltage value applied to the first TFT 34 and the current value flowing through the first TFT 34 is (voltage value, current value)=(3V, 1 μA) and (3.3V, 10 μA), and the ON-resistance of the third TFT 31 is 100 KΩ. In this case, in order to set the current flowing through the first TFT 34 to 1 μA, $$\text{precharge voltage}=3\ V+100\ K\Omega*1\ \mu A=\text{about } 3.1\ V.$$

In order to set the current flowing through the first TFT 34 to 10 μA, $$\text{precharge voltage}=3.3\ V+100\ K\Omega*10\ \mu A=4.3\ V.$$

Thus, by setting in this way, the precharge voltage can be appropriately set. However, the precharge voltage value is desirably set in consideration of the initial characteristic and the characteristic after deterioration because the characteristic change of the TFT in the pixel 5 is large.

The second gradation voltage generating circuit 22 generates the plurality of second gradation voltages based on the current Id/voltage Vg characteristic of the transistors of the current driver 28 so as to be adapted to the desirable gamma characteristic. The plurality of second gradation voltages are finely corrected based on the gamma control data by connecting a plurality of resistances in series so as to be adaptive for the gamma characteristic and generating desirable voltages from the respective nodes.

The current driver 28 receives the second gradation voltage, which has been selected based on the display data by the gradation voltage selecting circuit 25. The gradation voltage selecting circuit 25 receives the plurality of second gradation voltages predetermined. The plurality of second gradation voltages are gradation voltages set by the second gradation voltage generating circuit 22 so as to be a gradation current of the brightness (current)/gradation characteristic having the gamma characteristic shown in FIG. 15. The current driver 28 supplies the gradation current corresponding to the second gradation voltage to the pixel 5 through the data line 6 in the current drive period so that the pixel is driven. At this time, in the pixel 5, the third TFT 31 and the fourth TFT 34 are turned on. The gradation current Id generated by the current driver 28 flows through the first and third TFTs 31 and 34. A voltage corresponding to the gradation current Id is generated in the gate electrode of the first N-channel TFT 34. Then, the voltage is sample-held on the gate electrode of the first TFT 34 when the fourth TFT 34 is turned off. Next, the third TFT 31 is turned off, and the second TFT 32 is turned on. At this time, the first TFT 34 drives the electro-luminescent element 30. The same gradation current Id as the gradation current Id from the current driver 28 flows through the electro-luminescent element 30. As a result, the electro-luminescent element 30 emits light in the brightness corresponding to the gradation current value.

This current driver 28 is configured of the transistors of 1/n, compared with the conventional configuration using a plurality of current sources. Such a configuration of the current driver 28 contributes to considerably reduction of the circuit scale of the data line driving circuit 1. Also, the parasitic capacitance of the output electrode of the current driver 28 becomes constant without depending on the number of bits of the display data and can be decreased greatly. The relation among the voltage V which is driven by the current driver 28, the driving time T, the current I, and the capacity C, is expressed as $$I=CV/T$$

When the capacitance value decreases, the drive in a low current becomes possible, and the number of driving circuits and the power consumption in the display apparatus can be reduced.

Figure 21:
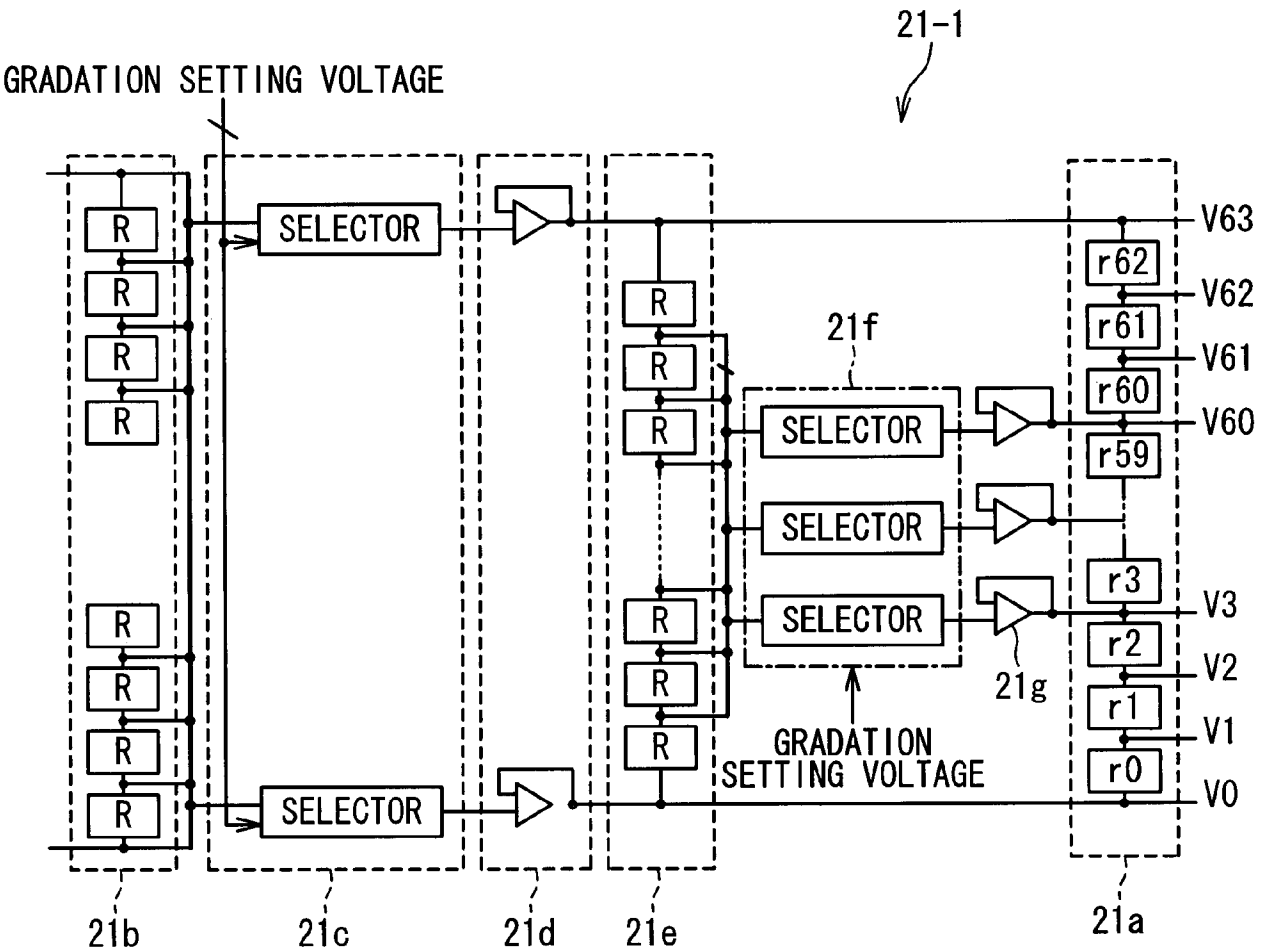
FIG. 21 is a block diagram showing another configuration of the first gradation voltage generating circuit.

FIG. 21 is a block diagram showing another configuration of the first gradation voltage generating circuit 21. A first gradation voltage generating circuit 21-1 shown in FIG. 21 includes a resistance string circuit 21*e*, a selector circuit 21*f*, and a voltage follower circuit 21*g* in addition to the first gradation voltage generating circuit 21. Here, the reference voltage generating circuit 21*b* and the selector circuit 21*c* are connected with each other as in the first gradation voltage generating circuit 21 shown in FIGS. 11A and 11B. Also, the resistance string circuit 21*e* and the selector circuit 21*f* are connected with each other in the same way as the reference voltage generating circuit 21*b* and the selector circuit 21*c* in the first gradation voltage generating circuit 21 shown in FIGS. 11A and 11B. The first gradation voltage generating circuit 21-1 further divides a voltage difference between a higher voltage and a lower voltage by the resistance string circuit 21*e* for the gamma correction by including the resistance string circuit 21*e*, the selector circuit 21*f*, and the voltage follower circuit 21*g*. According to the first gradation voltage generating circuit 21-1, a fine adjustment for the gamma correction can be facilitated without changing the maximum brightness or the minimum brightness.

Figure 22:
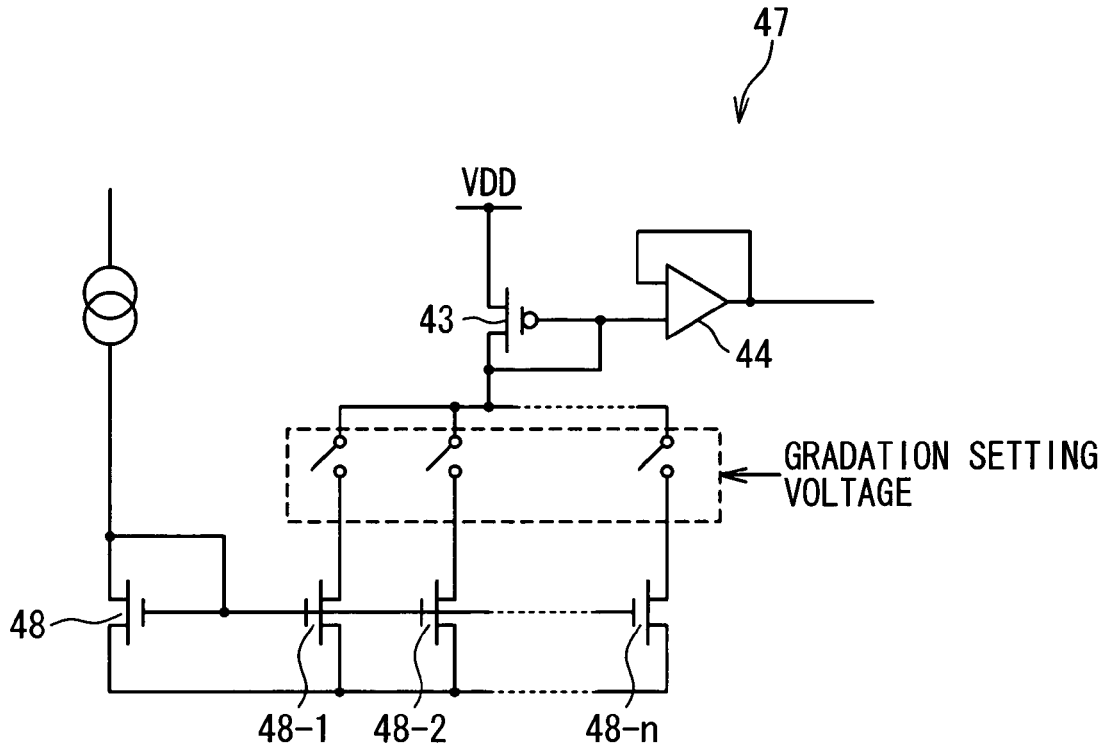
FIG. 22 is a circuit diagram showing a circuit of another configuration of the voltage generating circuit.

FIG. 22 is a circuit diagram showing a circuit 47 of another configuration of the voltage generating circuit 41 or 42. As shown in FIG. 22, the voltage generating circuit 47 includes a current mirror circuit. The current mirror circuit is configured from a specific transistor 48 corresponding to a reference current, and a plurality of transistors (48-1 to 48-*n*) corresponding to the specific transistor 48. The voltage generating circuit 47 supplies the reference current generated externally to the specific transistor 48. By forming the respective transistors 48-1 to 48-*n* (n is an arbitrary natural number) to have different transconductance coefficients, a plurality of different currents proportional to the current flowing through the specific transistor 48 can be obtained. The voltage generating circuit 47 selects one of the plurality of currents to supply the selected current to the reference voltage generating circuit 22*b*. The adoption of the configuration of the voltage generating circuit 47 shown in FIG. 22 contributes to appropriately generating and outputting the current supplied from the reference voltage generating circuit 22*b*.

Second Embodiment

Figure 23:
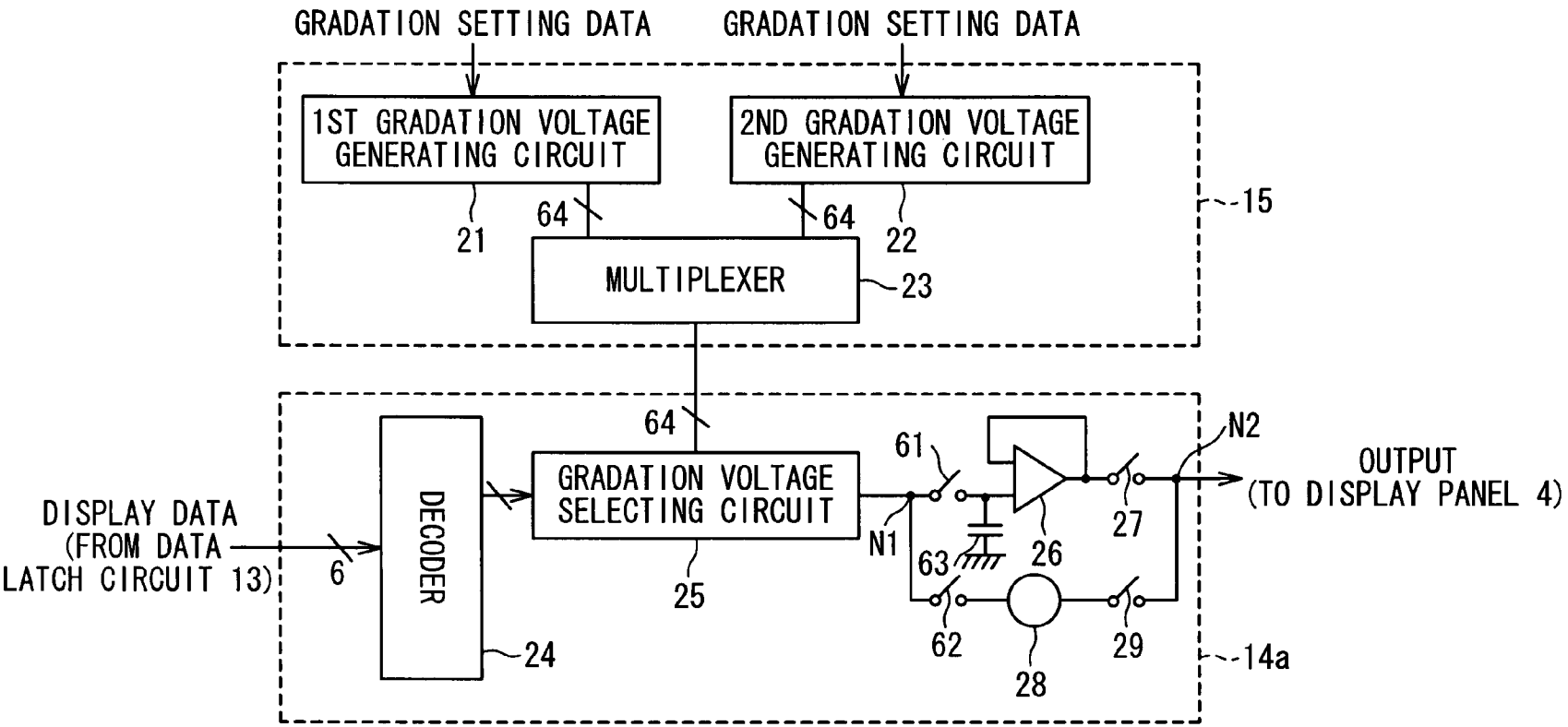
FIG. 23 is a block diagram showing the configuration of the D/A conversion circuit in a second embodiment of the present invention.

The second embodiment of the present invention will be described below. FIG. 23 is a block diagram showing the configuration of a D/A conversion circuit 14*a* in the second embodiment of the present invention. As shown in FIG. 23, the D/A conversion circuit 14*a* in the second embodiment includes a first switch 61, a second switch 62, and a capacitor 63 in addition to the configuration of the above-mentioned D/A conversion circuit 14. The first switch 61 is connected between the node N1 and the input of the voltage driver 26. The capacitor 63 is connected between the input of the voltage driver 26 and the ground potential. The voltage driver 26, the first switch 61 and the capacitor 63 configure a sample-hold circuit. Also, the second switch 62 is connected between the node 1 and the current driver 28.

An operation of the D/A conversion circuit 14*a* shown in FIG. 23 will be described below. The D/A conversion circuit 14*a* turns the first switch 61 off immediately before the current drive period (immediately before expiration of the precharge period) based on the timing control signal supplied from the timing control circuit 16. The sample-hold circuit is configured from the voltage driver 26, the first switch 61, and the capacitor 63, and carries out a sample holding operation of the first gradation voltage in response to the first switch 61 being turned off. The D/A conversion circuit 14*a* turns the second switch 62 on in response to a switching operation from the precharge period to the current drive period. At this time, the gradation voltages outputted from the multiplexer 23 are switched from the plurality of first gradation voltages to the plurality of second gradation voltages. The D/A conversion circuit 14*a* turns the second switch 29 on and turns the first switch 27 off after an input voltage to the current driver 28 is stabilized enough.

As shown in FIG. 19, the plurality of first gradation voltages and the plurality of second gradation voltages have potential differences of several volts. Therefore, it takes a certain period of time to switch from the plurality of first gradation voltages to the plurality of second gradation voltages. In addition, it takes a certain period of time for the voltage selected by the gradation voltage selecting circuit 25 to be switched. For these reasons, a glitch might be generated. In the above-mentioned configuration of the D/A conversion circuit 14*a*, the gradation voltage outputted from the multiplexer 23 restrains the glitch caused in the switching from the plurality of first gradation voltages to the plurality of second gradation voltages.

Third Embodiment

Figure 24:
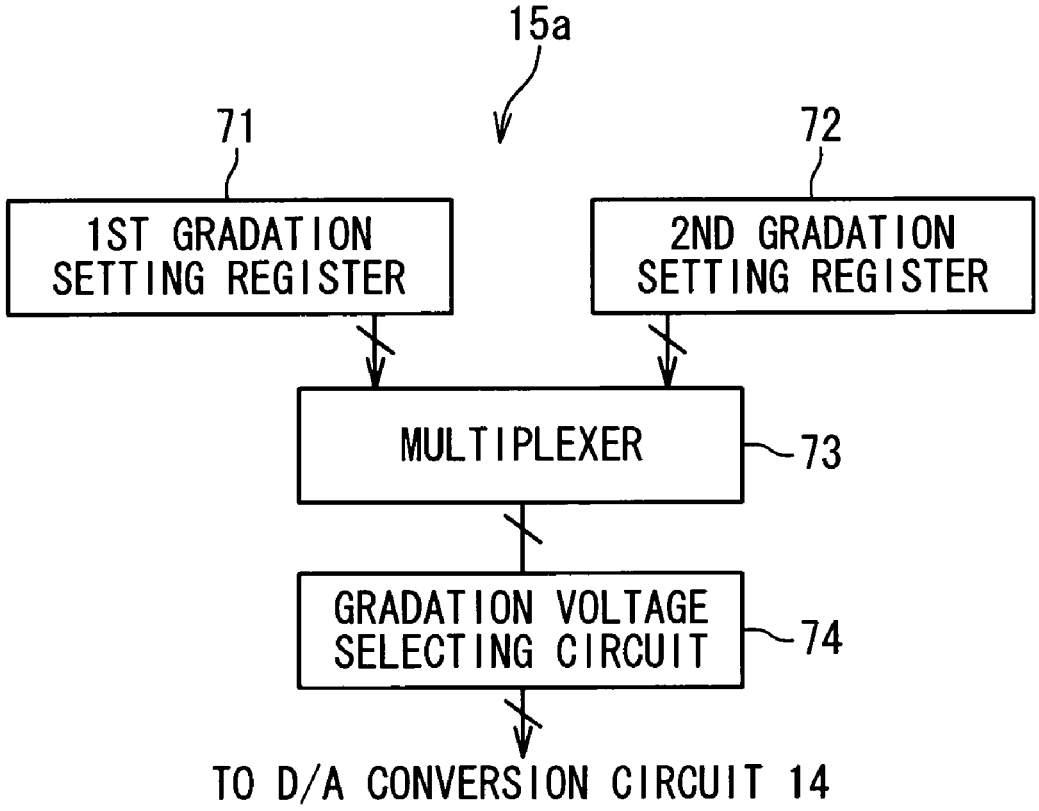
FIG. 24 is a block diagram showing the configuration of the gradation voltage generating circuit in the data line driving circuit according to a third embodiment of the present invention.

The third embodiment of the present invention will be described below. FIG. 24 is a block diagram showing the configuration of a gradation voltage generating circuit 15*a* in the data line driving circuit 1 according to the third embodiment of the present invention. As shown in FIG. 24, the gradation voltage generating circuit 15*a* in the third embodiment includes a first gradation setting register 71, a second gradation setting register 72, a multiplexer 73, and a gradation voltage generator 74. The first gradation setting register 71 is a memory circuit to store the first gradation setting data for the plurality of first gradation voltages. Similarly, and the second gradation setting register 72 is a memory circuit to store the second gradation setting data for the plurality of second gradation voltages. The multiplexer 73 selects one of the gradation setting data stored in the first gradation setting register 71 and the second gradation setting register 72, and outputs the selected gradation setting data. The gradation voltage generator 74 is a voltage generating circuit configured similarly to the first gradation voltage generating circuit 21 (or the second gradation voltage generating circuit 22).

An operation of the gradation voltage generating circuit 15*a* shown in FIG. 24 will be described below. The first gradation setting register 71 and the second gradation setting register 72 output the stored gradation setting data in response to a request from the multiplexer 73. The multiplexer 73 selects the gradation setting data from the first gradation setting register 71 in response to the timing control signal from the timing control circuit 16 in the precharge period and outputs the selected gradation setting data to the gradation voltage generator 74. Similarly, the multiplexer 73 selects the gradation setting data from the second gradation setting register 72 in response to the timing control signal from the timing control circuit 16 in the current drive period and outputs it to the gradation voltage generator 74. The gradation voltage generator 74 generates the plurality of first gradation voltages in the precharge period and generates the plurality of second gradation voltages in the current drive period, based on the output from the multiplexer 73. The plurality of first gradation voltages and the plurality of second gradation voltages generated by the gradation voltage generator 74 are outputted to the D/A conversion circuit 14.

The gradation voltage generating circuit 15 in the third embodiment can update the gradation setting data in the first gradation setting register 71 and the second gradation setting registers 72 so that the plurality of first gradation voltages and the plurality of second gradation voltages can be each generated arbitrarily and individually. As a result, for instance, in an organic electro-luminescence display apparatus for a cellular phone, when the emitted light from the organic electro-luminescence element cannot be seen because of the strong light of sunshine, a contrast can be set high by adjusting the maximum current value of the gradation current. Also, in a so-called stand-by state, that is, the state that the user does not use the phone, the low power consumption drive is possible by setting the maximum current value of the gradation current to low though the contrast decreases. This setting can be set in an arbitral period according to a state of use.

Fourth Embodiment

Figure 25:
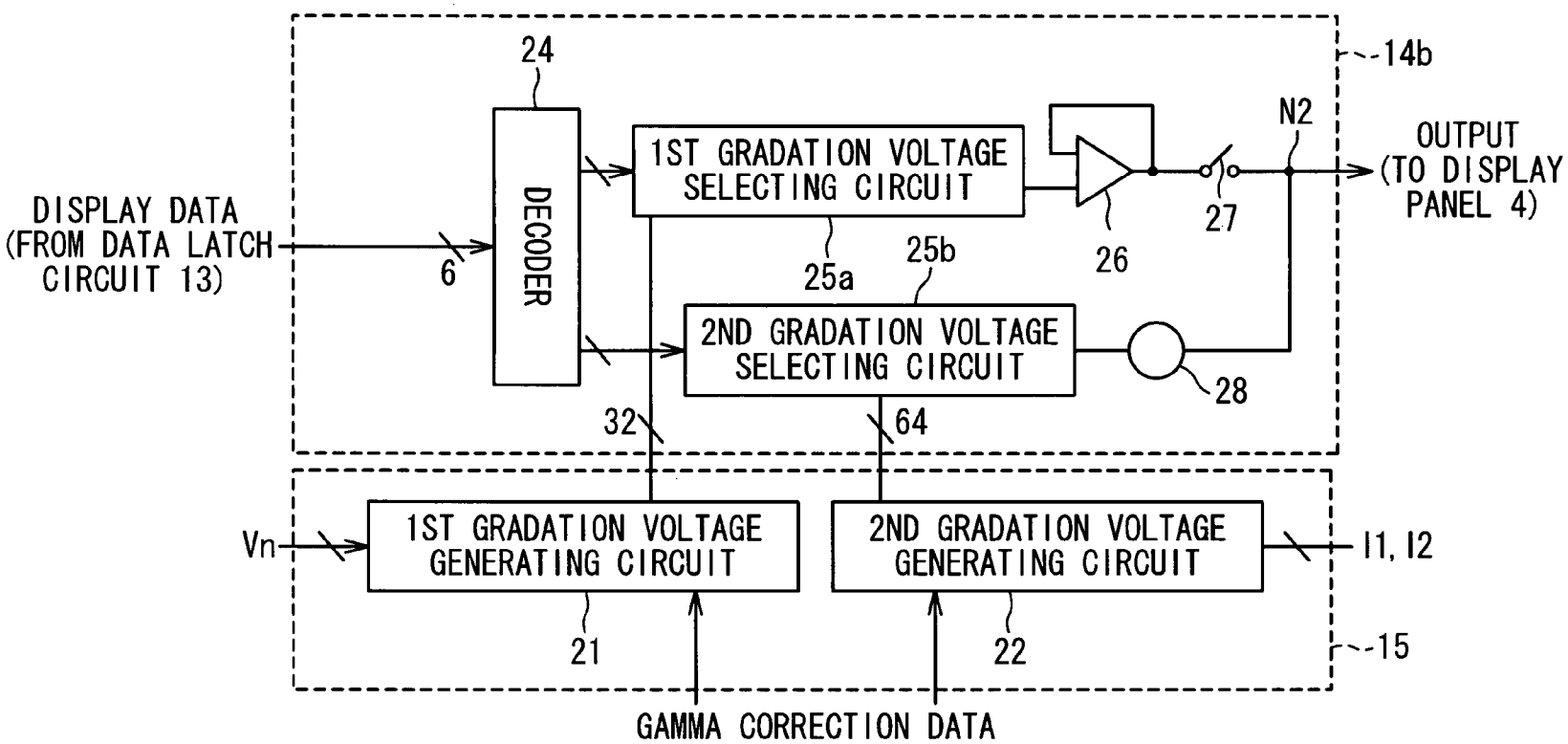
FIG. 25 is a block diagram showing the configuration of the D/A conversion circuit and the gradation voltage generating circuit in the fourth embodiment.

The fourth embodiment of the present invention will be described below. FIG. 25 is a block diagram showing the configuration of a D/A conversion circuit 14*b* and the gradation voltage generating circuit 15 in the fourth embodiment. As shown in FIG. 25, the D/A conversion circuit 14*b* includes the decoder 24, a first gradation voltage selecting circuit 25*a*, a voltage driver 26, a first switch 27, a current driver 28, and a second gradation voltage selecting circuit 25*b*. The first gradation voltage selecting circuit 25*a* selects a first specific one of the plurality of first gradation voltages supplied from the first gradation voltage generating circuit 21. Similarly, the second gradation voltage selecting circuit 25*b* selects a second specific one of the plurality of second gradation voltages supplied from the second gradation voltage generating circuit 22. An output of the first gradation selecting circuit 25*a* is connected with the input of the voltage driver 26. The output of the voltage driver 26 is connected with the first switch 27. A gradation voltage outputted from the voltage driver 26 is supplied to the data line 6 through the first switch 27 and the node N2. An input of the current driver 28 is connected with the output of the second gradation voltage selecting circuit 25*b*, and an output of the current driver 28 is connected with the node N2. A gradation current outputted from the current driver 28 is supplied to the data line 6 through the node N2.

In the fourth embodiment, it is desirable that the first gradation voltage selecting circuit 25*a* is configured from the transfer switches of CMOS transistors. The second gradation voltage selecting circuit 25*b* is configured in correspondence to the current driver 28. Therefore, when the current driver 28 is configured from the P-channel transistor, the second gradation voltage selecting circuit 25*b* is configured from the P-channel transistor.

Operations of the D/A conversion circuit 14*b* and the gradation voltage generating circuit 15 shown in FIG. 25 will be described below. As shown in FIG. 25, the decoder 24 decodes the display data supplied from the data latch circuit 13, and outputs the decoded data to the first gradation voltage selecting circuit 25*a* and the second gradation voltage selecting circuit 25*b*. The first gradation voltage selecting circuit 25*a* is supplied with the plurality of first gradation voltages generated by the first gradation voltage generating circuit 21 of the gradation voltage generating circuit 15 in addition to the decoded display data. Similarly, the second gradation selecting circuit 25*b* is supplied with the plurality of second gradation voltages generated by the second gradation voltage generating circuit 22 of the gradation voltage generating circuit 15 in addition to the decoded display data. The first gradation voltage selecting circuit 25*a* selects the first specific one from the plurality of first gradation voltages based on the display data from the decoder 24 and outputs the selected voltage to the voltage driver 26. Similarly, the second gradation selecting circuit 25*b* selects the specific second gradation voltage from the plurality of second gradation voltages based on the display data from the decoder 24 and outputs the selected voltage to the current driver 26. The voltage driver 26 carries out impedance conversion of the selected voltage from the first gradation selecting circuit 25*a* to produce the gradation voltage. The current driver 28 converts the selected voltage from the second gradation selecting circuit 25*b* to produce the gradation current.

Figure 26:
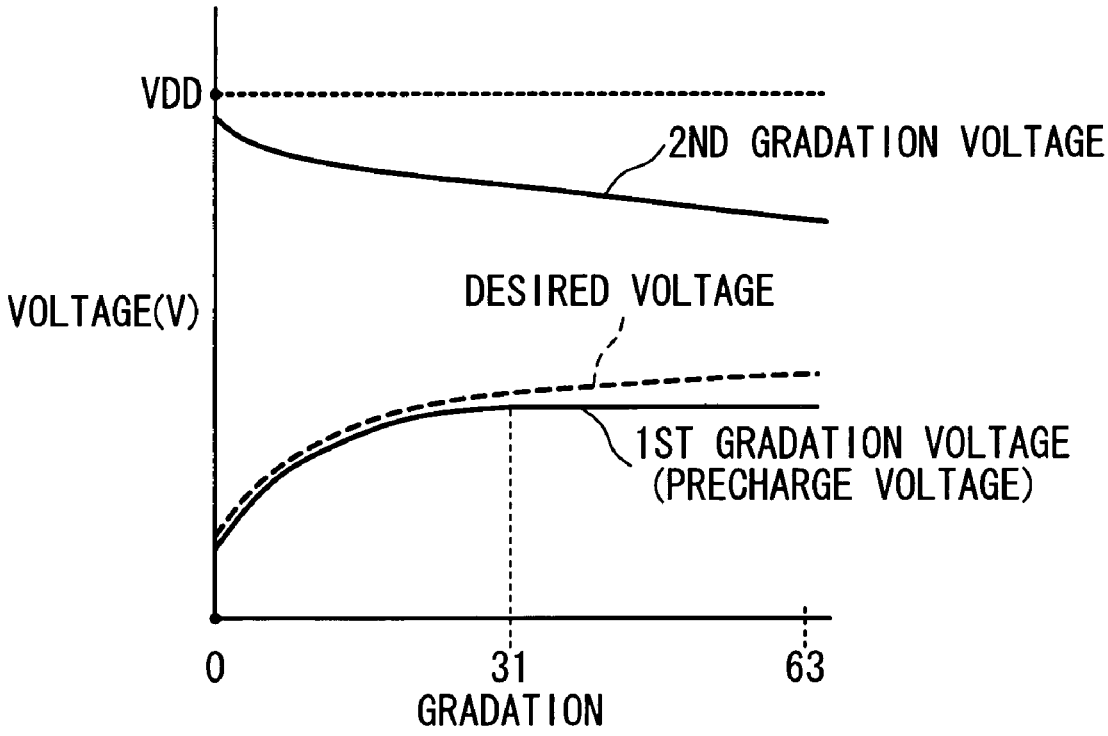
FIG. 26 is a characteristic chart of the gradation setting when the plurality of first gradation voltages and the plurality of second gradation voltages are set in a fourth embodiment.
Figure 27A:
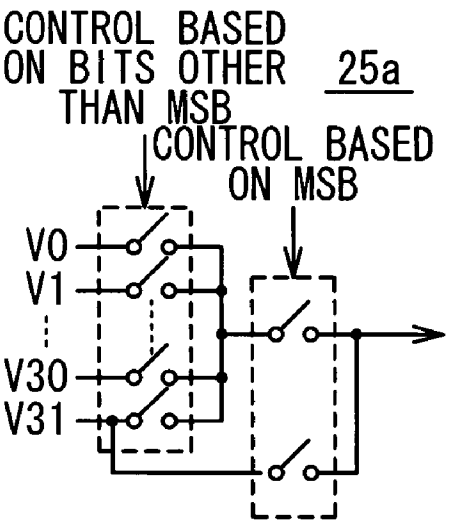
FIGS. 27A to 27C are circuit diagrams showing specific configurations of the first gradation selecting circuit.
Figure 27B:
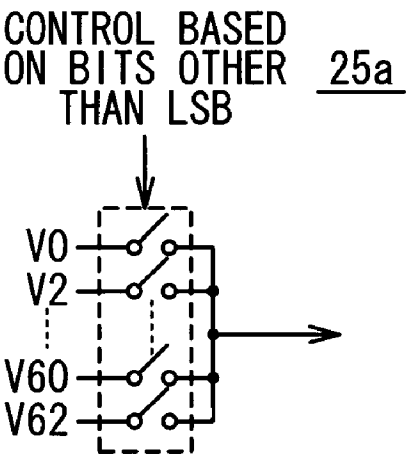
Figure 27C:
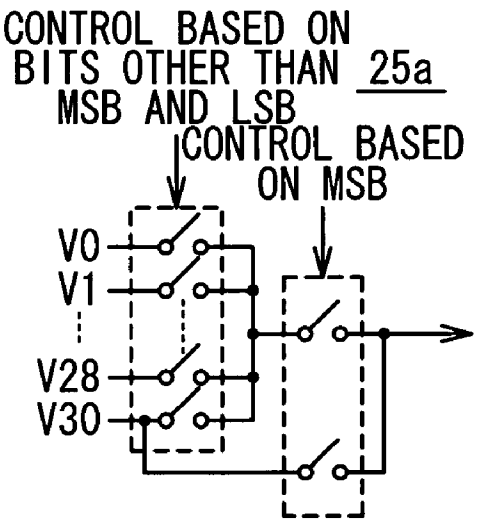

The operation in the fourth embodiment will be further described in detail with reference to FIG. 26 and FIGS. 27A to 27C. FIG. 26 is a characteristic chart of the gradation setting when the plurality of first gradation voltages and the plurality of second gradation voltages are set in the fourth embodiment. FIGS. 27A to 27C are circuit diagrams showing specific configurations of the first gradation selecting circuit 25*a*. FIG. 27A shows a circuit structure in case of the control of the selector circuit based on the most significant bit (MSB) and bits other than the MSB. FIG. 27B shows a circuit structure in case of the control of the selector circuit based on bits other than the least significant bit LSB. FIG. 27C shows a circuit structure in case of the control of the selector circuit based on bits other than the most significant bit (MSB) and the least significant bit (LSB).

As shown in FIG. 26, the plurality of first gradation voltages are set by using the 31-th gradation level which is an intermediate gradation level, as a boundary between a lower current region and a higher current region. The gradation voltages are set to be approximately adaptive for the characteristic of the pixel in the lower current region of 0-th to the 31-th gradation levels. The gradation voltages are set to same voltage as the gradation voltage of the 31-th gradation level in the higher current region of the 31-th to the 63-th gradation levels. The reason why the voltage drive is carried out before the current drive is in that the relation between a current drive time T and the current is expressed as $$T=CV/I,$$

so that it takes a certain time to reach the desirable voltage in case of smaller current.

The current is proportional to a square of the voltage in the current Id/voltage Vg characteristic of the driving TFT, i.e., $$Id=k(Vg-Vt)^2 \text{ (k is a proportion constant)}$$

Even if the precharge voltage is fixed in the middle or higher current region, the desired voltage can be obtained by only the gradation current from the current driver 28 in a short time because the voltage difference in the middle or higher current region is small. Therefore, the number of switches can be decreased to (32+2) by controlling the first gradation selecting circuit 25*a* with the bits other than the most significant bit (MSB) and the MSB as shown in FIG. 27A. The switches of the first gradation selecting circuit 25*a* are desirably configured of the transfer switch as mentioned above.

In addition, the precharge voltage is not necessary to have accuracy since the precharging operation is a preliminary operation before the current drive. As a result, the least significant bit (LSB) and a next bit of the least significant bit may be invalidated in order to decrease the number of switches. FIG. 27B shows the circuit in which the least significant bit is invalidated and only even-numbered gradation levels are set. In this case, the number of switches is reduced to 32. Further, FIG. 27C shows a circuit in which the drive voltage difference is small in the low current region in the current drive and the circuit is configured of a combination of the circuits shown in FIGS. 27A and 27B. In this case, the number of switches can be decreased to (16+2).

When the first TFT 34 is configured of the N-channel transistor, the current driver 28 is configured of the P-channel transistor. The precharge voltage is a voltage near to the lower power supply voltage, and the second gradation voltage is a voltage near to the higher power supply voltage. When the first TFT 34 is configured of the P-channel transistor, the current driver 28 is configured of the N-channel transistor. The precharge voltage is a voltage near to the higher power supply voltage, and the second gradation voltage is a voltage near to the lower power supply voltage. In this way, the second gradation voltage selecting circuit 25*b* may be configured of a transistor having one of the two conductive types.

The second gradation voltage selecting circuit 25*b* selects the second gradation voltage in the precharge period and the current drive period. Therefore, a glitch dose not occur, which has conventionally occurred due to the voltage delay in the switching from the first gradation voltage to the second gradation voltage. The drive ability of the voltage driver 26 is 100 times or more larger than that of the current driver 28, whose current value is about 20 μA at maximum. Therefore, the precharge voltage is hardly influenced even if the voltage driver 26 and the current driver 28 are operated at the same time in the precharge period.

Fifth Embodiment

Figure 28:
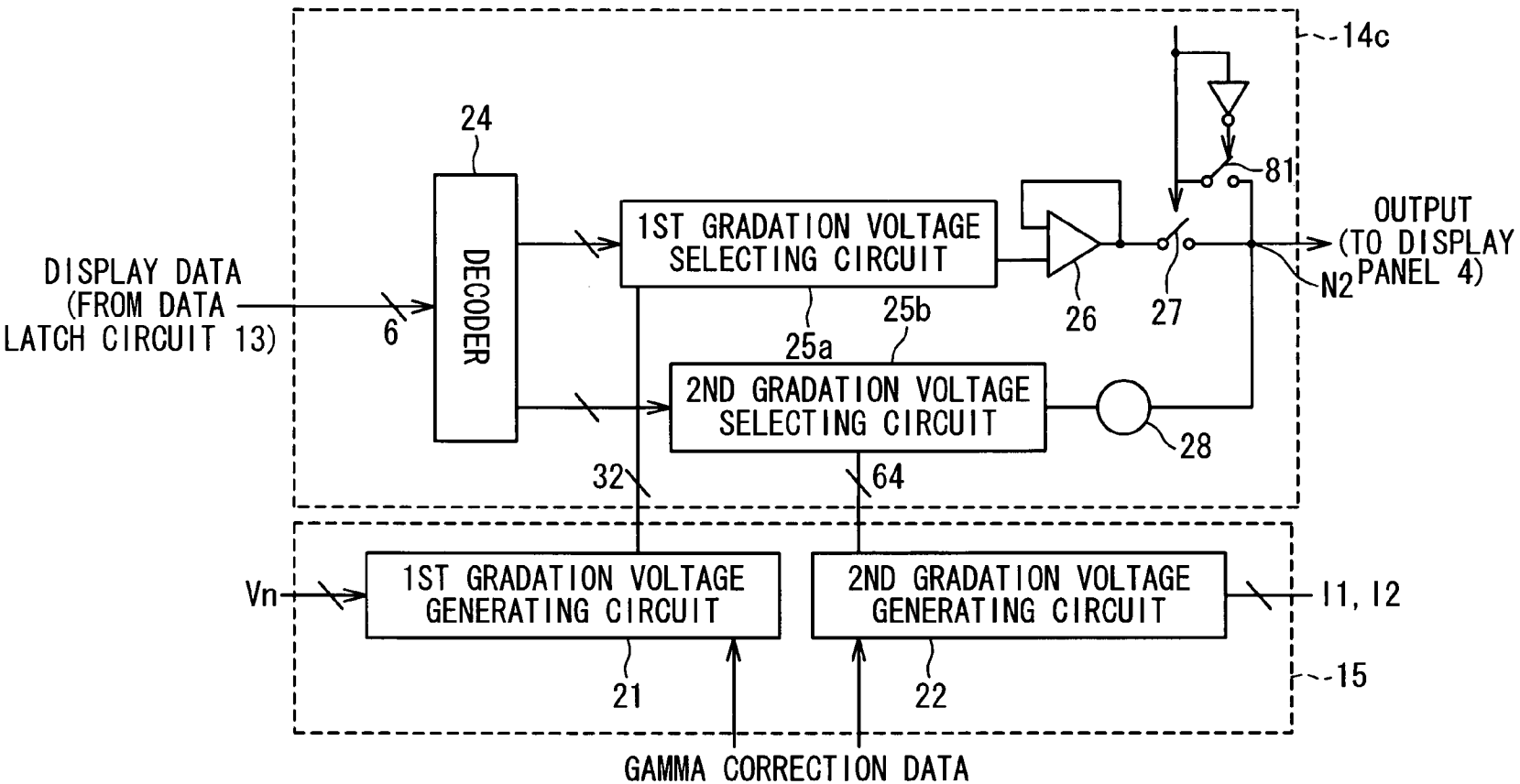
FIG. 28 is a block diagram showing the configuration of the D/A conversion circuit and the gradation voltage generating circuit in a fifth embodiment of the present invention.

The fifth embodiment of the present invention will be described below. FIG. 28 is a block diagram showing the configuration of a D/A conversion circuit 14*c* and the gradation voltage generating circuit 15 in the fifth embodiment of the present invention. As shown in FIG. 28, the D/A conversion circuit 14*c* includes a dummy switch 81 in addition to the above-mentioned D/A conversion circuit 14*b*. Referring to FIG. 28, the dummy switch 81 is connected with the data line 6 through the node N2. The output of the voltage driver 26 is connected with the data line 6 through the first switch 27 and the node N2. Each of the first switch 27 and the dummy switch 81 is configured from a transistor. The transistors have the same gate length L. The gate width W of the transistor of the dummy switch 81 is a half width of that of the transistor of first switch 27. In addition, a source and a drain of the transistor of the dummy switch 81 are short-circuited.

An operation of the D/A conversion circuit 14*c* shown in FIG. 28 will be described below. As mentioned above, the operation of the first switch 27 is controlled depending on whether the data line drive period is the precharge period or the current drive period. The D/A conversion circuit 14*c* is controlled so that the first switch 27 and the dummy switch 81 operate in opposite phases respectively. That is, when the first switch 27 is turned on, the D/A conversion circuit 14*c* turns the dummy switch 81 off. When the first switch 27 is turned off, the D/A conversion circuit 14*c* turns the dummy switch 81 of.

A glitch is caused by a circuit delay and a noise of the switch. The noise generated from the first switch 27 can be decreased by controlling the operation of the dummy switch 81 in the D/A conversion circuit 14*c* as described above. As a result, the glitch is restrained and quality of image to be displayed is improved in the display apparatus.

Figure 29:
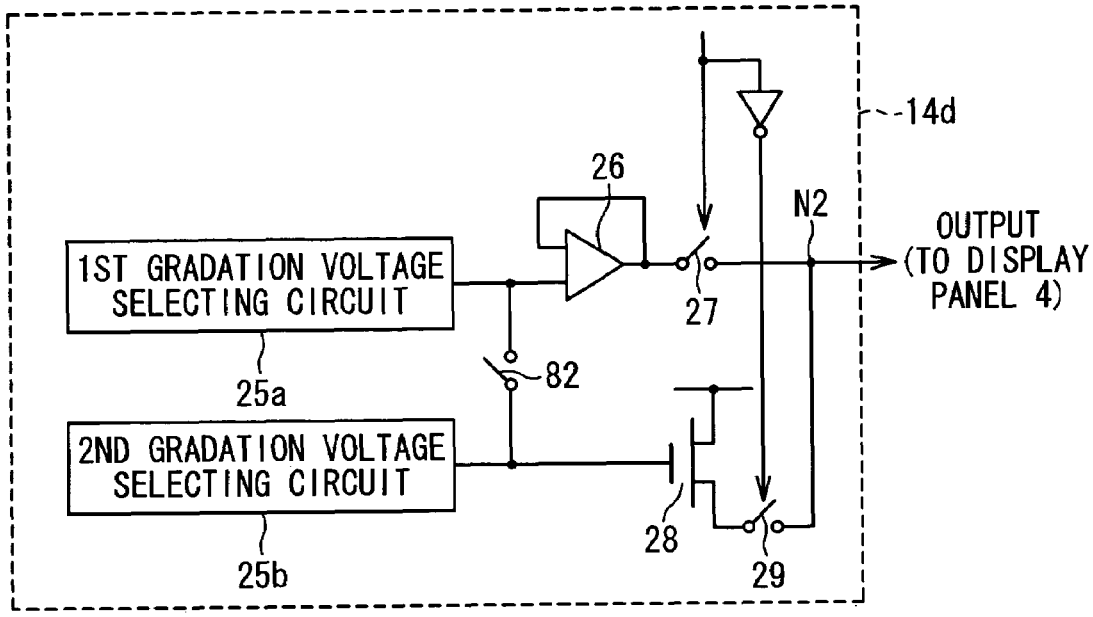
FIG. 29 is a block diagram showing the D/A conversion circuit in which a second switch is provided between the current driver and the data line.

The D/A conversion circuit 14*c* can be substituted by a D/A conversion circuit 14*d* in which a second switch 29 is provided between the current driver 28 and the data line 6 as shown in FIG. 29. In this case, the second switch 29 is turned off in the precharge period. The first switch 27 is controlled to be switched from the ON state to the OFF state in the switching from the precharge period to the current drive period. Here, in the switching, the second switch 29 is controlled to be switched from the OFF state to the ON state so that the period during which the first and second switches 27 and 29 are both turned on is present. The period during which the first and second switches 27 and 29 are both turned on contributes to restrain the glitch and quality of the image to be displayed is improved in the display apparatus.

Sixth Embodiment

Figure 30:
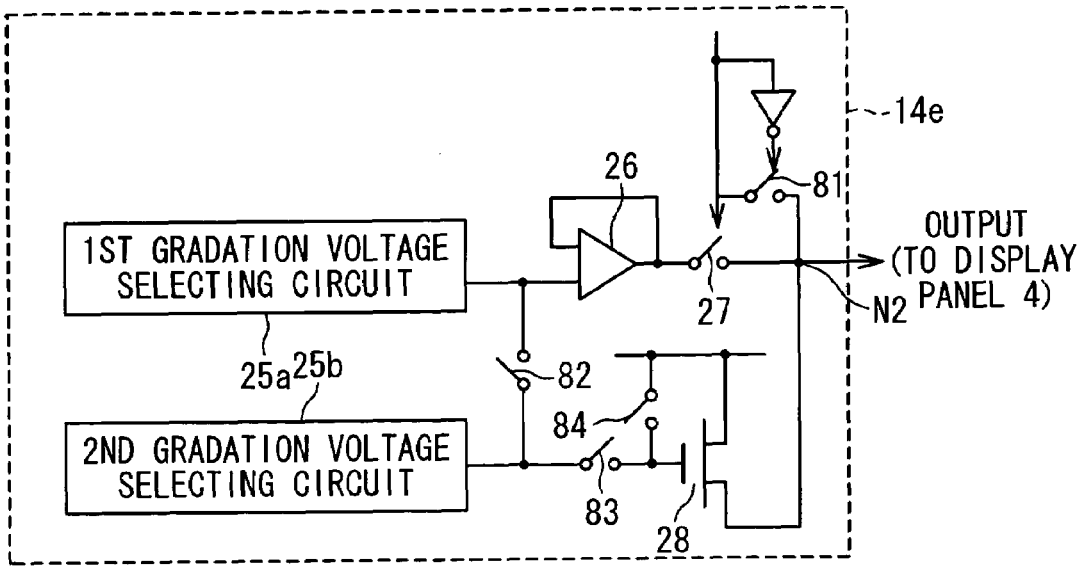
FIG. 30 is a block diagram showing the configuration of the D/A conversion circuit in a sixth embodiment of the present invention.

The sixth embodiment of the present invention will be described below. FIG. 30 is a block diagram showing a configuration of a D/A conversion circuit 14*e* in the sixth embodiment of the present invention. As shown in FIG. 30, the D/A conversion circuit 14*e* includes test switches for a final test carried out in shipping of the data line driving circuit 1. The D/A conversion circuit 14*e* includes a first test switch 82, a second test switch 83, and a third test switch 84.

An operation of the D/A conversion circuit 14*e* shown in FIG. 30 in a test mode will be described below. In a first stage in the test mode, it is checked whether or not the current corresponding to the 0-th gradation level is supplied from the current driver 28. In addition, it is checked whether or not currents of the first gradation level and the maximum gradation level are respectively within a predetermined current range. In a second stage in the test mode, the third test switch 84 is turned on, and the second test switch 83 is turned off. As a result, the current of the current driver 28 is blocked off. Further, all the switches of the first gradation voltage selecting circuit 25*a* are turned off to disconnect the first gradation voltage selecting circuit 25*a* from the voltage driver 26. Then, the first test switch 82 is turned on in order to connect the second gradation selecting circuit 25*b* and the voltage driver 26. At this time, whether the voltage of the second gradation selecting circuit 25*b* is within a predetermined range is checked for another gradation test. Here, the current corresponding to the 0-th gradation level is ideally 0 μA. Therefore, the 0-th gradation level can be checked by confirming the presence of a leakage current. Thus, the tests of the 0-th gradation level, the first gradation level, and the maximum gradation level are carried out by using the current driver 28. Then, the other gradation tests are carried out by using the voltage driver 26. In this way, the test can be completed in short time.

Seventh Embodiment

Figure 31:
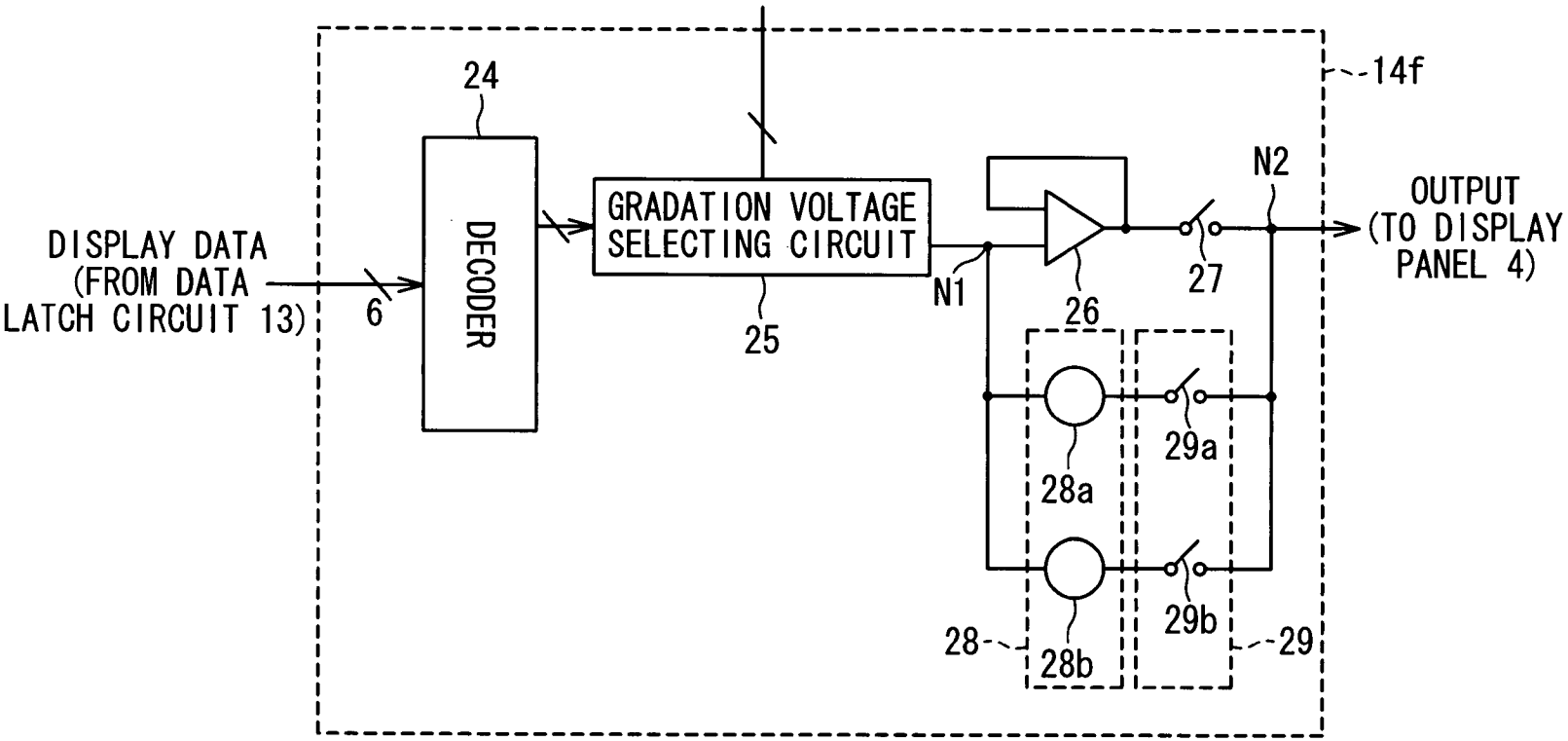
FIG. 31 is a block diagram showing the configuration of the D/A conversion circuit in the seventh embodiment of the present invention.

The seventh embodiment of the present invention will be described below. FIG. 31 is a block diagram showing the configuration of a D/A conversion circuit 14*f* in the seventh embodiment of the present invention. As shown in FIG. 31, the current driver 28 of the D/A conversion circuit 14*f* is configured from a first current driver 28*a* and a second current driver 28*b*. In addition, the second switch 29 of the D/A conversion circuit 14*f* is configured from a first current switch 29*a* and a second current switch 29*b*.

The first current driver 28*a* receives the gradation voltage selected by the gradation voltage selecting circuit and generates a flowing-out current based on the gradation voltage. The second current driver 28*b* receives the gradation voltage selected by the gradation voltage selecting circuit, and generates a flowing-in current based on the gradation voltage. As shown in FIG. 31, the input of the first current driver 28*a* is connected with the output of the gradation voltage selecting circuit 25 through the node N1. The output of the first current driver 28*a* is connected with the data line 6 through the first current switch 29*a* and the node N2. Similarly, the input of the second current driver 28*b* is connected with the output of the gradation voltage selecting circuit 25 through the node N1. The output of the second current driver 28*b* is connected with the data line 6 through the second current switch 29*b* and the node N2. Either the first current driver 28 or the second current driver 28*b* in the current driver 28 is specified based on the first TFT 34 in the pixel 5. Either the first current switch 29*a* or the second current switch 29*b* is specified in the second switch 29 based on the first TFT 34 of the pixel 5. The specified current switch 29*a* or 29*b* is turned on in the current drive period in response to the timing control signal supplied from the timing control circuit 16. As a result, the data line driving circuit 1 can be configured without depending on whether or not the first TFT 34 of the pixel 5 is of the N-channel transistor or the P-channel transistor. Therefore, in the manufacture of the driving circuit of the display apparatus, it is possible to flexibly cope with the configuration of the pixel 5 by switching the first current switch 29*a* and the second current switch 29*b*. This accomplishes the decrease in development cost. Trial manufactures of many kinds of panels are carried out depending on the design of the pixels in the development stage of the panel. Especially, in this stage, the quality of the panel can be tested by driving the panel by the same product.

Eighth Embodiment

Figure 32:
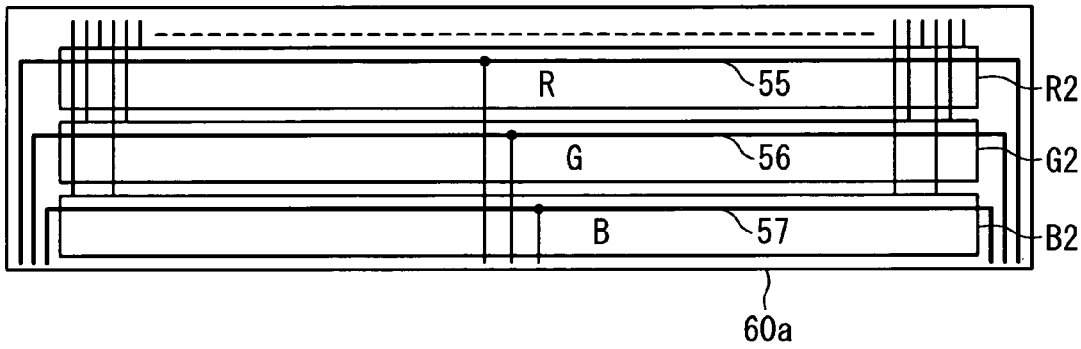
FIG. 32 is a diagram showing another layout of each circuit in the data line driving circuit.

The eighth embodiment of the present invention will be described below. The eighth embodiment is related to a layout of each circuit of the data line driving circuit 1. The layout of each circuit in the data line driving circuit 1 is desirable to be the layout shown in FIG. 14. However, other configurations are acceptable under a certain condition. FIG. 32 is a block diagram showing another layout of each circuit in the data line driving circuit 1. As shown in FIG. 32, a wiring 55 of R, a wiring 56 of G, and a wiring 57 of B are arranged as an arrangement 60*a*. The power supply voltage of the current driver 28 can be arranged in a different region for each of the RGB colors in the arrangement 60*a*. Though the gradation wiring area is three times wider than the arrangement shown in FIG. 14, the arrangement 60*a* is desirable when the drive voltage of the pixel to be driven is different for each RGB color.

The D/A conversion circuit 14 and the gradation voltage generating circuit 15 are arranged separately in a unit of an R (red) area R2, a G (green) area G2, and a B (blue) area B2 at least. In this case, the shift register circuit 11, the data register circuit 12, and the data latch circuit 1 may be arranged separately, and may be arranged in a same area. Thus, the power supply voltage and the gamma characteristic of the current driver 28 are changed for each of the RGB colors to achieve the display apparatus with high quality of display.

Figure 33:
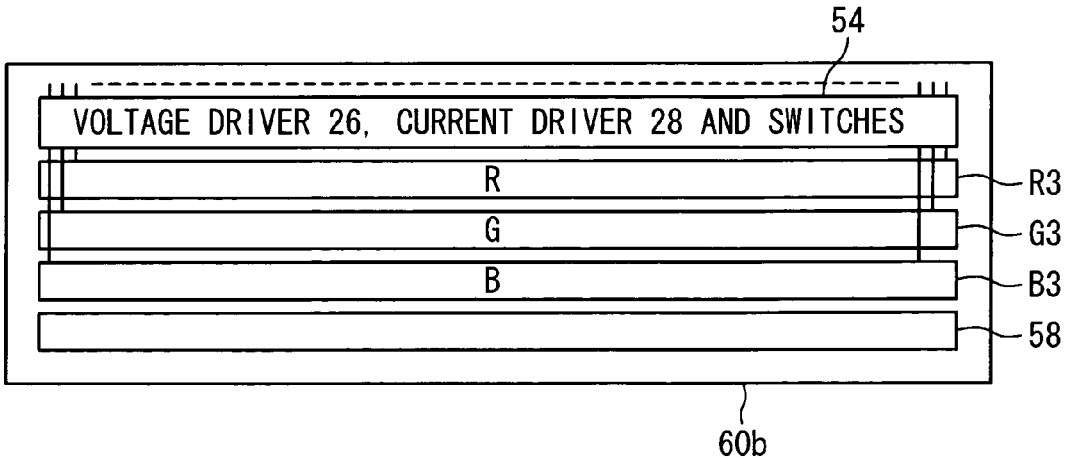
FIG. 33 is a diagram showing still another layout of the data line driving circuit.

FIG. 33 is a diagram showing still another layout of the data line driving circuit. As shown in an arrangement 60*b* of FIG. 33, the shift register circuit 11 is arranged in a second specific area 58. The data register circuit 12, the data latch circuit 13, the decoder 24 and the gradation voltage selecting circuit 25 (the first gradation selecting circuit 25*a* and the second gradation selecting circuit 25*b*) as a part of the D/A conversion circuit 14, and the gradation voltage generating circuit 15 are arranged separately for each of the RGB colors. An R (red) area R3, a G (green) area G3 and a B (blue) area B3 are areas where circuits corresponding to the R (red), the G (green) and the B (blue) are arranged. The voltage driver 26, the current driver 28 and the switches in the D/A conversion circuit 14 are all arranged in a second specific area 58 to decrease a parasitic capacitance at the output terminals. In the arrangement 66*b* shown in FIG. 33, the parasitic capacitance is small because the wiring length from the output terminal is short. Therefore, if the number of wirings on which the gradation voltages or currents are outputted is lager than the number of the output terminals, the arrangement 60 of FIG. 14 is preferable, and if the number of wirings on which the gradation voltages or currents are outputted is less than the number of output terminals, the arrangement 60*b* of FIG. 33 is preferable.

Ninth Embodiment

Figure 34:
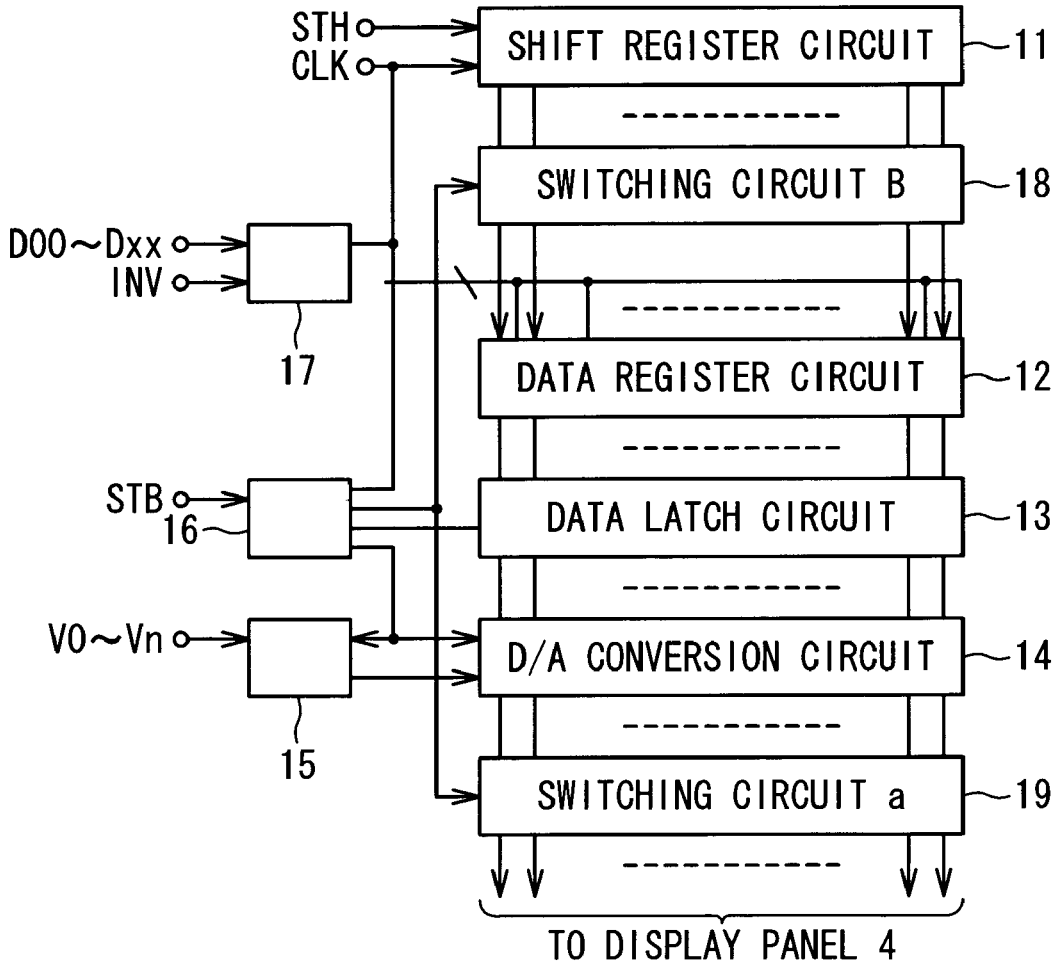
FIG. 34 is a block diagram showing the configuration of the data line driving circuit in a ninth embodiment of the present invention.

The ninth embodiment of the present invention will be described below. FIG. 34 is a block diagram showing the configuration of the data line driving circuit 1 in the ninth embodiment of the present invention. The data line driving circuit 1 in the ninth embodiment includes a switch circuit section in addition to the components of the above-mentioned data line driving circuit 1. The switch circuit section connects the data lines 6 to the D/A conversion circuit while sequentially switching the data lines 6. As shown in FIG. 34, the switch circuit section is composed a switch circuit A 18 and a switch circuit B 19. The switch circuit A 18 is connected with the output of the D/A conversion circuit, and the switch circuit B 19 is connected with the output of the shift register circuit 11 to switch image data by changing the order of sampling pulses.

The switch circuit section may switch the image data for every frame period or for every horizontal line. Also, the switching order may be random or regular. The control circuit 3 receives the clock signal CLK, a horizontal sync signal Hs, and a vertical sync signal Vs and generates timing signals to control the switch circuit section and the timing of the latch signal. The switch circuit section may be manufactured on a glass substrate and the other circuits may be manufactured on a silicon substrate. The deviation in characteristics of the current drivers 28 of each D/A conversion circuit 14 is distributed to time and space by the switch circuit section of the data line driving circuit 1 in the ninth embodiment. As a result, the image quality of the display apparatus can be improved.

Tenth Embodiment

Figure 35:
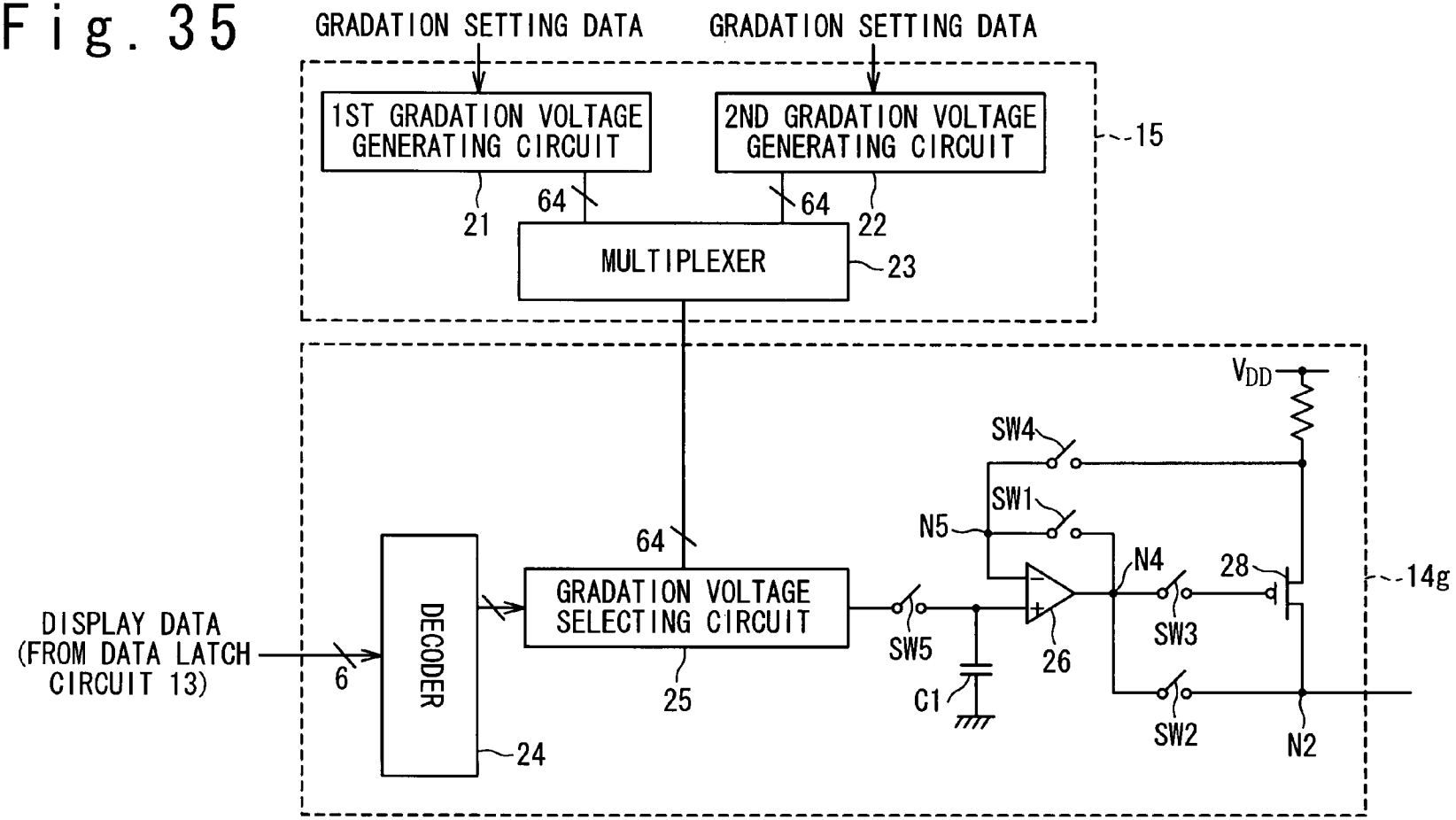
FIG. 35 is a block diagram showing the configuration of the gradation voltage generating circuit and the D/A conversion circuit in a tenth embodiment of the present invention.

The tenth embodiment of the present invention will be described below. FIG. 35 is a block diagram showing the configuration of the gradation voltage generating circuit 15 and a D/A conversion circuit 14*g* in the tenth embodiment of the present invention. The data line driving circuit 1 in the tenth embodiment of the present invention includes the gradation voltage generating circuit 15 and the D/A conversion circuit 14*g* connected with the gradation voltage generating circuit 15. In addition, the D/A conversion circuit 14*g* includes the decoder 24, the gradation voltage selecting circuit 25, the voltage driver 26, the current driver 28, a capacitor C1, and a plurality of switches (SW1 to SW5). The gradation voltage generating circuit 15, the decoder 24, and the gradation voltage selecting circuit 25 in the tenth embodiment have the same configuration in the above-mentioned embodiments. Therefore, the detailed description thereof is omitted in the following description.

The voltage driver 26 shown in FIG. 35 can drive the data line 6 in a high drive ability as mentioned above. Also, the current driver 28 can drive the data lines 6 in a constant current determined based on the selected gradation voltage as mentioned above. As shown in FIG. 35, the first gradation voltage generating circuit 21 of the gradation voltage generating circuit 15 is connected with the multiplexer 23. Similarly, the second gradation voltage generating circuit 22 is connected with the multiplexer 23.

The output terminal of the gradation voltage selecting circuit 25 is connected with a normal input terminal of the voltage driver 26 through the switch SW5. Moreover, the capacitor C1 is connected between the normal input terminal and the ground potential. The output terminal of the voltage driver 26 is connected with a node N4. The switch SW1 is connected between the node N4 and an inversion input terminal of the voltage driver 26 through a node N5. Also, the output terminal of the voltage driver 26 is connected with the switch SW2 through the node N4. The voltage driver 26 operates as a voltage follower by shutting the switches SW1 and SW2 at the same time. In addition, the switch SW3 is connected between the output of the voltage driver 26 is connected with the switch SW3 and the gate of the P-channel transistor of the current driver 28 through the node N4. Also, the switch SW4 is connected between the inversion input terminal of the voltage driver 26 and the source of the above-mentioned P-channel transistor through the node N5. The drain of the P-channel transistor is connected with the data line 6 (not shown) through the node N2. The above-mentioned switch SW2 is connected with the data line 6 through the node N2.

Figures 36A, 36B, 36C, 36D, 36E:
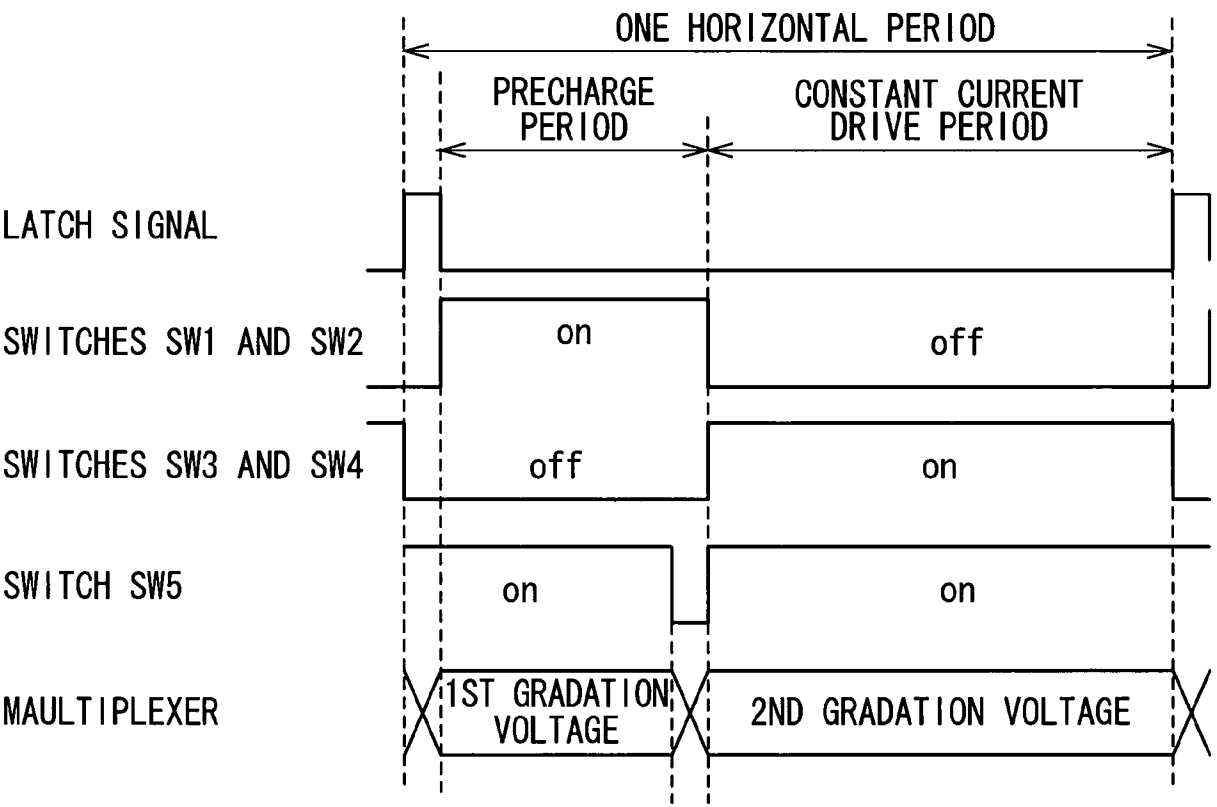
FIGS. 36A to 36E are timing charts showing an operation of the tenth embodiment.

FIGS. 36A to 36E are timing charts showing an operation of the tenth embodiment. One horizontal period in the tenth embodiment includes the precharge period and the current drive period. FIG. 36A shows an operation waveform of the latch signal. FIGS. 36A to FIG. 36D shows the timing of ON/OFF of each switch in the D/A conversion circuit 14*g*. FIG. 36E shows an output from the multiplexer 23.

As shown in FIGS. 36A to 36E, each of the switches SW1 and SW2 is set to the ON state in the precharge period (FIG. 36B). At this time, the switches SW3 and SW4 are set to the OFF state (FIG. 36C). As shown in FIG. 36E, the first gradation voltage is outputted from the multiplexer 23 in the precharge period. When the capacitor C1 is charged up to the first gradation voltage, the switch SW5 is turned off immediately before switching from the precharge period to the current drive period. The first gradation voltage is held since the switch SW5 is turned off. Each of the switches SW1 and SW2 is switched from the ON state to the OFF state in the current drive period (FIG. 36B). At this time, each of the switches SW3 and SW4 is switched from the OFF state to the ON state (FIG. 36C). The second gradation voltage is outputted from the multiplexer 23 in the current drive period. The switch SW5 is set to the ON state after the output of the gradation voltage selecting circuit 25 is switched into the second gradation voltage.

Figure 37:
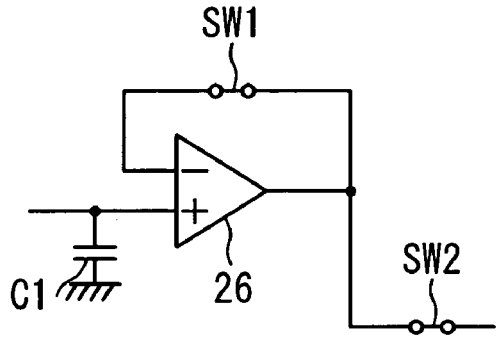
FIG. 37 is a circuit diagram showing the configuration of a circuit in the latter stage of the gradation voltage selecting circuit in a precharge period.

FIG. 37 is a circuit diagram showing the configuration of a circuit in the latter stage of the gradation voltage selecting circuit 25 in the above-mentioned precharge period. As shown in FIG. 37, the first gradation voltage is supplied from the gradation voltage selecting circuit 25 to the data line 6 through the voltage follower when the switches SW1 and SW2 are turned on (closed), and the switches SW3 and SW4 are turned off (opened) in the precharge period. It should be noted that though being not shown in FIG. 37, it is desirable that a switch which operates in conjunction with the switch SW3 is provided on the gate of the P-channel transistor of the current driver 28. It is preferable that the operating switch is connected with a signal line which has the same voltage as the signal voltage in a high level, and operates to supply the signal voltage of the high level to the above-mentioned gate in response to the switch SW3 being turned off.

Figure 38:
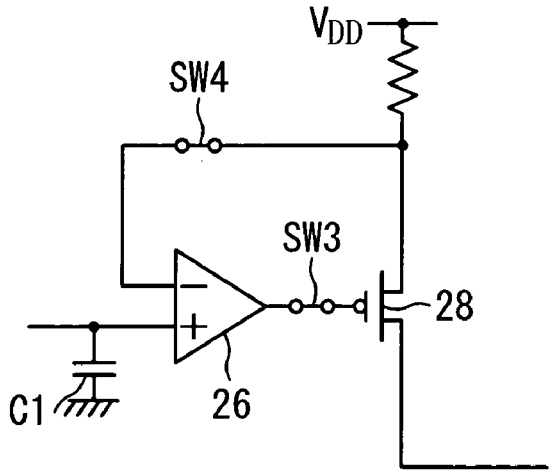
FIG. 38 is a circuit diagram showing the configuration of the circuit in the latter stage of the gradation voltage selecting circuit in a current drive period.

FIG. 38 is a circuit diagram showing the configuration of the circuit in the latter stage of the gradation voltage selecting circuit 25 in the above-mentioned current drive period. As shown in FIG. 38, the output terminal of the voltage driver 26 is connected with the gate of the P-channel transistor of the current driver 28 when the switches SW1 and SW2 are opened, and the switches SW3 and SW4 are closed in the current drive period. As a result, the current driver 28 shown in FIG. 38 generates the gradation current for driving the pixel 5 in response to the output from the voltage driver 26 and supplies the gradation current to the data line 6. The configuration of the D/A conversion circuit 14*g* in the tenth embodiment enables the pixel to be driven with a slight current. Moreover, the glitch generated at the switching from the voltage drive to the current drive can be restrained. Therefore, it is possible to prevent the generation of an irregular display.

It is possible to combine the embodiments described above as long as being not conflicted with each other. Also, the data line drive period mentioned above is not necessarily same length as one horizontal period at each line scanning. In order to reduce the circuit scale of the data line driving circuit 1, one horizontal period may be divided into three drive periods based on 3-color pixels, for instance. In this case, the data latch circuit outputs three display data of three data lines 6 sequentially for every drive period. The D/A conversion circuit may be shared for every three data lines 6. The tree data lines 6 of the display panel 4 in the display apparatus are driven in a time divisional manner for every drive period of the three data lines 6 in response to the output from the D/A conversion circuit.

In the drive circuit of the display apparatus of the present invention, the plurality of gradation voltage subjected to the gamma correction are generated, and one selected from the plurality of gradation voltage is D/A-converted. Then, a desired gradation current is generated by the current driver with a single transistor based on the D/A conversion result of the selected gradation voltage. Thus, the circuit scale of the D/A converting circuit in the data line drive circuit can be made small. Since the D/A conversion circuit is provided for every data line or every data lines, the circuit scale of the data line drive circuit can be also reduce.

Also, according to the drive circuit of the display apparatus of the present invention, the gamma correction can be carried out without increasing the number of bits of the display data. Thus, the power consumption between the control circuit and the data line drive circuit can be restrained. Also, since the current driver of the D/A conversion circuit is composed of a single transistor so that parasitic capacity is decreased, the data line can be driven with a sufficiently smaller current value. In addition, the drive current for the pixel is set individually in the gradation voltage generation circuit previously. Also, the data line drive circuit drives the data line and the pixel at high speed with the precharge voltage by the voltage driver in the precharge period. Then, the data line and the pixel are driven by the current driver in the current drive period. Therefore, a voltage amplitude when the data line and the pixel are driven by the voltage driver can be made smaller. Also, the pixel can be driven with a sufficiently small current in a short time.

Moreover, the drive circuit of the display unit according to the present invention generates the plurality of gradation voltages from the resistance string circuit. Therefore, the gradation voltage increases monotonously. Also, because a current is generated from the gradation voltage by the current driver with a single transistor, the data line drive circuit of the current drive type can be produced, resulting in improvement of the image quality.

Moreover, the drive circuit of the display unit according to the present invention, the monotonous increase of the gradation voltage can be confirmed based on only the voltage levels for the 0-th gradation level, the first gradation level and the maximum gradation level. The test of bit dependence can be carried out at high speed by testing the input of the current driver by the voltage driver.

Moreover, the drive circuit of the display unit according to the present invention, the data line drive circuit is formed on the silicon substrate and the gradation voltage is set individually by the gradation voltage generation circuit in consideration of the degradation of transistor characteristic on the glass substrate. Thus, the data line drive circuit can be produced to have less deviation in characteristic and less influence of the degradation of transistor characteristic produced on the glass substrate.

Moreover, in the drive circuit of the display unit according to the present invention, a current drive is carried out by the current driver while the voltage drive period is carried out by the voltage driver. Therefore, no delay is caused in switching from the voltage drive to the current drive. Thus, the generation of a glitch due to noise of the switch can be restrained.

What is claimed is:

1. A drive circuit for a display panel, comprising:

a gradation voltage generating circuit which includes a first voltage generating circuit whose output is connected with a first wiring line;

a second voltage generating circuit whose output is connected with a second wiring line; and a first resistance string circuit adaptive for a gamma characteristic, and provided between said first and second wiring lines, wherein said first voltage generating circuit comprises:

a power supply line;

a first current source;

a first transistor whose current path is connected with said power supply line and said first current source, and whose control gate is connected with said first current source; and a voltage follower circuit provided between said control gate and said first wiring line.

2. A drive circuit for a display panel, comprising:

a gradation voltage generating circuit which includes a first voltage generating circuit whose output is connected with a first wiring line;

a second voltage generating circuit whose output is connected with a second wiring line; and a first resistance string circuit adaptive for a gamma characteristic, and provided between said first and second wiring lines, wherein said first voltage generating circuit comprises:

a power supply line;

a first current source;

a first transistor whose current path is connected with said power supply line and said first current source, and whose control gate is connected with said first current source; and a voltage follower circuit provided between said control gate and said first wiring line, and wherein said first voltage generating circuit further comprises:

a second resistance string circuit provided between said first and second wiring lines;

a selector configured to select a predetermined node of nodes of said second resistance string circuit to output a predetermined voltage; and a voltage follower provided between an output of said selector and a node of said first resistance string circuit.

3. A drive circuit for a display apparatus, which a pixel including a light emitting element and arranged at intersection of a data line and a scanning line, a brightness of said pixel being controlled on a gradation current, comprising:

a gradation voltage generation circuit configured to generate a plurality of first gradation voltages different from each other and a plurality of second gradation voltages different from each other; and a D/A conversion circuit configured to drive said data line with a gradation voltage based on one of said plurality of first gradation voltages as a first specific gradation voltage in a first period and to drive said data line with said gradation current based on one of said plurality of said second gradation voltages as a second specific gradation voltage in a second period.

4. The drive circuit according to claim 3, wherein said D/A conversion circuit comprises:

a voltage driver configured to drive said data line with said gradation voltage based on said first specific gradation voltage in said first period; and a current driver configured to drive said data line with said gradation current based on said second specific gradation voltage to in said second period.

5. The drive circuit according to claim 4, wherein said pixel includes a driving transistor to drive said light emitting element, said current driver includes a current driver transistor, and a conductive type of said driving transistor is opposite to that of said current driver transistor.

6. The drive circuit according to claim 5, wherein said current driver comprises:

a first current driver configured to flow out said gradation current; and a second current driver configured to suck said gradation current, said D/A conversion circuit further comprises:

a fifth switch interposed between said first current driver and said data line; and a sixth switch interposed between said second current driver and said data line, and one of said fifth switch and said sixth switch is activated based on a conductive type of said driving transistor.

7. The drive circuit according to claim 5, wherein said pixel is formed on a glass substrate, and said current driver and said second gradation voltage generating circuit are formed on a semiconductor chip.

8. The drive circuit according to claim 4, wherein said D/A conversion circuit further comprises:

a first switch interposed between said voltage driver and said data line, such that said first switch connects said voltage driver with said data line in said first period and disconnects said voltage driver from said data line in said second period.

9. The drive circuit according to claim 4, wherein said D/A conversion circuit further comprises:

a decoder configured to decode display data; and a gradation voltage selecting circuit configured to select said first specific gradation voltage from said plurality of first gradation voltages in said first period based on said display data decoded by said decoder to supply to said voltage driver, and to select said second specific gradation voltage from said plurality of second gradation voltages in said second period based on said display data decoded by said decoder to supply to said current driver.

10. The drive circuit according to claim 4, wherein said D/A conversion circuit further comprises:

a second switch interposed between said current driver and said data line, such that said second switch disconnects said current driver from said data line in said first period, and connects said current driver with said data line in said second period.

11. The drive circuit according to claim 4, wherein said D/A conversion circuit further comprises:

a capacitor connected between an input of said voltage driver and a ground potential;

a third switch interposed between said gradation voltage selecting circuit and said voltage driver to connect said gradation voltage selecting circuit with said voltage driver and said capacitor in said first period; and a fourth switch interposed between said gradation voltage selecting circuit and said current driver to connect said gradation voltage selecting circuit with said current driver in said second period.

12. The drive circuit according to claim 4, wherein said D/A conversion circuit comprises:

a decoder configured to decode display data;

a first gradation voltage selecting circuit configured to select said first specific gradation voltage from said plurality of first gradation voltages in said first period to supply to said voltage driver; and a second gradation voltage selecting circuit configured to select said second specific gradation voltage from said plurality of second gradation voltages in said second period to supply to said current driver.

13. The drive circuit according to claim 12, wherein said first gradation voltage selecting circuit comprises a plurality of first selection switches connected in parallel, and when said display data is n bits, a number of said plurality of first selection switches is less than $2^n$, and said second gradation voltage selecting circuit comprises a plurality of second selection switches connected in parallel, and a number of said plurality of second selection switches is $2^n$.

14. The drive circuit according to claim 12, wherein said second gradation voltage selecting circuit is separated for each of RGB colors and are arranged in a continuous area.

15. The drive circuit according to claim 4, wherein a bias current is supplied to said voltage driver in said first period such that said voltage driver is activated and said bias current is blocked off in said second period such that said voltage driver is inactivated.

16. The drive circuit according to claim 4, wherein said current driver comprises a MOS-type transistor, and a gate voltage of said MOS-type transistor is controlled such that said gradation current is generated.

17. The drive circuit according to claim 4, wherein said voltage driver is configured of a transistor of a same conductive type as transistors of said second gradation voltage selecting circuit.

18. The drive circuit according to claim 3, wherein said gradation voltage generating circuit comprises:

a first gradation voltage generating circuit configured to generate said plurality of first gradation voltages adaptive for a current-voltage characteristic of said pixel; and a second gradation voltage generating circuit configured to generate said second plurality of gradation voltages adaptive for a gamma characteristic of said light emitting element.

19. The drive circuit according to claim 18, wherein said gradation voltage generating circuit further comprises:

a multiplexer connected with said first gradation voltage generating circuit and said second gradation voltage generating circuit and configured to select said plurality of first gradation voltages in said first period to output to said D/A conversion circuit, and to select said plurality of second gradation voltages in said second period to output to said D/A conversion circuit.

20. The drive circuit according to claim 18, wherein said first gradation voltage generating circuit generates said plurality of first gradation voltages based on first gradation setting data, and said second gradation voltage generating circuit generates said second plurality of gradation voltages based on a second setting data.

21. The drive circuit according to claim 20, wherein said gradation voltage generating circuit comprises:

a first gradation setting data register configured to hold first gradation setting data;

a second gradation setting data register configured to hold second setting data;

a multiplexer configured to select said first setting data in said first period, and to select said second setting data in said second period; and said gradation voltage generating circuit configured to generate said plurality of first gradation voltages based on said first setting data in said first period, and to generate said plurality of second gradation voltages based on said second setting data in said second period.

22. The drive circuit according to claim 20, wherein said first gradation voltage generating circuit comprises:

a first reference voltage generating circuit configured to generate a plurality of voltages;

a first selector circuit configured to select a first reference voltage and a second reference voltage from said plurality of voltages supplied from said reference voltage generating circuit based on said first setting data; and a first voltage follower circuit configured to carry out impedance conversion of said first reference voltage and said second reference voltage; and a first resistance string circuit configured to voltage-divide a voltage difference between said first reference voltage and said second reference voltage after the impedance conversion and to generate said plurality of first gradation voltages.

23. The drive circuit according to claim 22, wherein said first gradation voltage generating circuit comprises:

a second resistance string circuit configured to voltage-divide a voltage difference between said first reference voltage and said second reference voltage after the impedance conversion and to generate a plurality of voltages; and a correcting circuit configured to correct said plurality of voltages generated by said second resistance string circuit based on said first setting data.

24. The drive circuit according to claim 20, wherein said second gradation voltage generating circuit comprises:

a second reference voltage generating circuit configured to generate a plurality of voltages based on first and second voltage;

a first voltage supply circuit configured to supply said first voltage to said reference voltage generating circuit;

a second voltage supply circuit configured to supply said second voltage to said reference voltage generating circuit;

a second selector circuit configured to select a third reference voltage and a fourth reference voltage from said plurality of voltages supplied from said second reference voltage generating circuit based on second setting data;

a second voltage follower circuit configured to carry out impedance conversion to said third reference voltage and said fourth reference voltage; and a third resistance string circuit configured to voltage-divide a voltage difference between said third reference voltage and said fourth reference voltage after the impedance conversion to adapt to a gamma characteristic of said light emitting element to generate said plurality of second gradation voltages.

25. The drive circuit according to claim 24, wherein each of said first voltage supply circuit and said second voltage supply circuit comprises:

a current source;

a reference voltage follower circuit; and a reference voltage generation transistor, wherein a source of said reference voltage generation transistor is connected with said power supply line, a drain thereof is connected with said current source, and a gate thereof is connected with said drain thereof and is connected with an input of said reference voltage follower circuit.

26. The drive circuit according to claim 3, wherein a row of specific connection pads is provided between a row of connection pads for input signals and power supply voltages and a row of pads for output terminals of said D/A conversion circuit, and a plurality of first power supply voltages are supplied to said voltage drivers through said row of specific connection pads.

27. The drive circuit according to claim 3, wherein at least one of said gradation voltage generating circuit and said D/A conversion circuit is formed on a semiconductor chip.

28. A display apparatus comprising:

a plurality of data lines;

a plurality of scanning lines arranged in a direction orthogonal to said plurality of data lines;

a pixel arranged at each of intersections said plurality of data lines and said plurality of scanning lines, wherein said pixel has a light emitting element which changes a brightness in response to a supplied signal, wherein a pixel comprises a light emitting element and arranged at intersection of a data line and a scanning line, a brightness of said pixel being controlled on a gradation current; and a data line driving circuit configured to drive each of said plurality of data lines when each of said plurality of scanning lines is selected, wherein said data line drive circuit comprises:

a gradation voltage generation circuit configured to generate a plurality of first gradation voltages different from each other and a plurality of second gradation voltages different from each other; and a D/A conversion circuit configured to drive said data line with a gradation voltage based on one of said plurality of first gradation voltages as a first specific gradation voltage in a first period and to drive said data line with a gradation current based on one of said plurality of said second gradation voltages as a second specific gradation voltage in a second period.

29. The display apparatus according to claim 28, wherein said D/A conversion circuit comprises:

a voltage driver configured to drive said data line with said gradation voltage based on said first specific gradation voltage in said first period; and a current driver configured to drive said data line with said gradation current based on said second specific gradation voltage to in said second period.

30. The display apparatus according to claim 29, wherein said gradation voltage generating circuit comprises:

a first gradation voltage generating circuit configured to generate said plurality of first gradation voltages adaptive for a current-voltage characteristic of said pixel;

a second gradation voltage generating circuit configured to generate said second plurality of gradation voltages adaptive for a gamma characteristic of said light emitting element; and a multiplexer connected with said first gradation voltage generating circuit and said second gradation voltage generating circuit and configured to select said plurality of first gradation voltages in said first period to output to said D/A conversion circuit, and to select said plurality of second gradation voltages in said second period to output to said D/A conversion circuit.

31. The display apparatus according to claim 29, wherein said gradation voltage generating circuit comprises:

a first gradation setting data register configured to hold first gradation setting data;

a second gradation setting data register configured to hold second gradation setting data;

a multiplexer configured to select said first setting data in said first period, and select said second setting data in said second period; and said gradation voltage generating circuit configured to generate said plurality of first gradation voltages based on said first setting data in said first period, and to generate said plurality of second gradation voltages based on said second setting data in said second period.

32. The display apparatus according to claim 29, wherein said D/A conversion circuit further comprises:

a first switch interposed between said voltage driver and said data line, such that said first switch connects said voltage driver with said data line in said first period and disconnects said voltage driver from said data line in said second period;

a decoder configured to decode display data; and a gradation voltage selecting circuit configured to select said first specific gradation voltage from said plurality of first gradation voltages in said first period based on said display data decoded by said decoder to supply to said voltage driver, and to select said second specific gradation voltage from said plurality of second gradation voltages in said second period based on said display data decoded by said decoder to supply to said current driver.

33. The display apparatus according to claim 29, wherein said D/A conversion circuit further comprises:

a first switch interposed between said voltage driver and said data line, such that said first switch connects said voltage driver with said data line in said first period and disconnects said voltage driver from said data line in said second period;

a decoder configured to decode display data;

a first gradation voltage selecting circuit configured to select said first specific gradation voltage from said plurality of first gradation voltages in said first period to supply to said voltage driver, wherein said first switch is connected between said first gradation voltage selecting circuit and said data line; and a second gradation voltage selecting circuit configured to select said second specific gradation voltage from said plurality of second gradation voltages in said second period to supply to said current driver.

34. The display apparatus according to claim 28, wherein a row of specific connection pads is provided between a row of connection pads for input signals and power supply voltages and a row of pads for output terminals of said D/A conversion circuit, and a plurality of first power supply voltages are supplied to said voltage drivers through said row of specific connection pads.

* * * * *

UNITED STATES PATENT AND TRADEMARK OFFICE

CERTIFICATE OF CORRECTION

PATENT NO. : 7,595,776 B2
APPLICATION NO. : 11/045608
DATED : September 29, 2009
INVENTOR(S) : Hashimoto et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1278 days.

Signed and Sealed this

Twenty-eighth Day of September, 2010

David J. Kappos

David J. Kappos
*Director of the United States Patent and Trademark Office*